US007700883B2

(12) United States Patent
Masago et al.

(10) Patent No.: US 7,700,883 B2
(45) Date of Patent: Apr. 20, 2010

(54) TERMINAL FOR ENGAGING TYPE CONNECTOR

(75) Inventors: Yasushi Masago, Shimonoseki (JP); Ryoichi Ozaki, Shimonoseki (JP); Kouichi Taira, Shimonoseki (JP)

(73) Assignee: (Kobe Steel, Ltd.), Kobe-shi (JP)

( * ) Notice: Subject to any disclaimer, the term of this patent is extended or adjusted under 35 U.S.C. 154(b) by 0 days.

(21) Appl. No.: 12/101,398

(22) Filed: Apr. 11, 2008

(65) Prior Publication Data

US 2008/0257581 A1 Oct. 23, 2008

(30) Foreign Application Priority Data

Apr. 20, 2007 (JP) ..... 2007-112399
May 1, 2007 (JP) ..... 2007-120644

(51) Int. Cl.
*H01B 5/00* (2006.01)

(52) U.S. Cl. ..... 174/126.2

(58) Field of Classification Search ..... 174/126.2, 174/126.3

See application file for complete search history.

(56) References Cited

U.S. PATENT DOCUMENTS 5,366,814 A * 11/1994 Yamanishi et al. ..... 428/607
6,759,142 B2 7/2004 Hara et al.

FOREIGN PATENT DOCUMENTS

| | | |
|---|---|---|
| EP | 1 788 585 A1 | 5/2007 |
| JP | 2004-68026 | 3/2004 |
| JP | 2004-300524 | 10/2004 |
| JP | 2005-105307 | 4/2005 |
| JP | 2005-183298 | 7/2005 |
| JP | 2006-77307 | 3/2006 |
| JP | 2006-183068 | 7/2006 |

* cited by examiner

*Primary Examiner*—Chau N Nguyen
(74) *Attorney, Agent, or Firm*—Oblon, Spivak, McClelland, Maier & Neustadt, L.L.P.

(57) ABSTRACT

A terminal for an engaging type connector includes a punched Cu alloy strip as a base material, a coating formed on the Cu alloy strip by postplating processes and including a Sn layer, and a Cu—Sn alloy layer sandwiched between the base material and the Sn layer. The Sn layer is smoothed by a reflowing process. The terminal has an engaging part and a solder-bonding part, and the surface of a part of the base material corresponding to the engaging part has a surface roughness higher than that of the surface of the base material corresponding to the solder-bonding part. The engaging part has a low frictional property and the solder-bonding part has improved solder wettability.

10 Claims, 10 Drawing Sheets

TERMINAL FOR ENGAGING TYPE CONNECTOR

BACKGROUND OF THE INVENTION

1. Field of the Invention

The present invention relates to a terminal, for an engaging type connector, having an engaging part and a solder-bonding part.

2. Description of the Related Art

Mentioned in JP-A 2006-77307 is a conducting material, for a connecting part, having high electrical reliability (low contact resistance) and a low frictional property, and suitable for forming a terminal for an engaging type connector. The technique disclosed in JP-A 2006-77307 uses a copper alloy strip having a surface roughness greater than that of ordinary copper alloy strips as a base material, forms a plated Ni layer, a plated Cu layer and a plated Sn layer in that order, forms a plated Cu layer and a plated Sn layer in that order, or forms only a plated Sn layer on the surface of the base material, processes the plated Sn layer by a reflowing process to form a Cu—Sn alloy layer by the plated Cu layer and the plated Sn layer, or by the copper alloy base material and the plated Sn layer, and exposes the Cu—Sn alloy layer partly through the plated Sn layer smoothed by the reflowing process. (Parts of the Cu—Sn alloy layer corresponding to projections in the roughened surface of the base material are exposed.) The conducting material mentioned in JP-A 2006-77307, for connecting parts, formed after the reflowing process has a coating including the Cu—Sn alloy layer and the Sn layer, or the Ni layer, the Cu—Sn alloy layer and the Sn layer formed in that order, and in some cases, a Cu layer remains between the surface of the base material and the Cu—Sn alloy layer, or between the Ni layer and the Cu—Sn alloy layer. It is specified that the areal exposure ratio, namely, the areal ratio of the exposed parts, of the Cu—Sn alloy layer is between 3% and 75%, the Cu—Sn alloy layer has a mean thickness between 0.1 and 3.0 μm and a Cu content between 20 and 70 atomic % and the Sn layer has a mean thickness between 0.2 and 5.0 μm. It is mentioned in JP-A 2006-77307 that it is desirable that the surface of the base material has an arithmetic mean roughness Ra of 0.15 μm or above with respect to one direction and an arithmetic mean roughness Ra of 4.0 μm or below with respect to all directions, and intervals of the exposed parts of the Cu—Sn alloy layer are between 0.01 and 0.5 mm.

A conducting material for connecting parts corresponding to a subordinate concept of JP-A 2006-77307, and a method of manufacturing the conducting material are disclosed in JP-A 2006-183068. The construction of the plated layer and the construction of the coating after the reflowing process of the conducting material disclosed in JP-A 2006-183068 are the same as those of the conducting material disclosed in JP-A 2006-77307.

It is specified in JP-A 2006-183068 that the areal ratio of exposed parts of the Cu—Sn alloy layer of the conducting material, for a connecting part, after the reflowing process is between 3% and 75%, the Cu—Sn alloy layer has a mean thickness between 0.2 and 3.0 μm and a Cu content between 20 and 70 atomic % and the Sn layer has a mean thickness between 0.2 and 5.0 μm. It is mentioned in JP-A 2006-183068 that it is desirable that the surface of the base material has at least an arithmetic mean roughness Ra of 0.15 μm or above with respect to one direction and an arithmetic mean roughness Ra of 3.0 μm or below with respect to all directions. It is also mentioned that it is desirable that the surface of the base material has at least an arithmetic mean roughness Ra of 0.3 μm or above and an arithmetic mean roughness of 4.0 μm or below with respect to all directions, and intervals of the exposed parts of the Cu—Sn alloy layer at least in one direction are between 0.01 and 0.5 mm.

Techniques disclosed in JP-A 2004-300524, JP-A 2005-105307, and JP-A 2006-183298 process a Cu alloy strip by a punching process and Sn-plates the punched Cu alloy strip to coat the entire surface of the punched Cu alloy strip including edges of punched openings to provide terminals or the like having an improved solder-bonding property as compared with that of terminals made from a Cu alloy strip that is Sn-plated before being subjected to a punching process.

It is mentioned in JP-A 2004-68026 that a conducting material, for a connecting part, including a Cu alloy base material, and coating including a Ni layer, a Cu—Sn alloy layer, and a Sn layer is excellent in forming an engaging type terminal having a low frictional property when the Sn layer has a comparatively small thickness of 0.5 μm or below, and is excellent in solder-bonding property when the Sn layer has a comparatively big thickness greater than 0.5 μm.

Each of conducting materials, for a connecting part, disclosed in JP-A 2006-77307 and JP-A 2006-183068 includes a Sn layer forming an outermost layer, and a base material having a surface having a large surface roughness, and hence parts of the hard Cu—Sn alloy layer are exposed. Particularly, the Cu—Sn layer of the conducting material mentioned in JP-A 2006-183068 protrudes. Therefore, a terminal has high electrical reliability and a low frictional property and is suitable for use as an engaging type terminal. Since parts of the Cu—Sn alloy layer are exposed in the surface of the material, the material is inferior in solder-bonding property to a material entirely coated with a Sn layer.

An engaging type terminal having a soldering part, such as a pin terminal employed in a printed wiring board, is required to have a low frictional property so that the engaging type terminal can be fitted in a receiving part by a low pressure, and the soldering part is required to be excelling in solder-bonding property.

It is desirable to use either of the materials mentioned in JP-A 2006-77307 and JP-A 2006-183068 to form a terminal having a low frictional property. However those materials are unsatisfactory in solder-bonding property. Although the improvement of the solder-bonding property can be achieved by the postplating process as mentioned in those patent documents, it goes without saying that such an improvement is not a substantial improvement.

When a thick plated Sn layer is formed by a postplating process to improve the solder-bonding property as mentioned in JP-A 2004-68026, friction increases and hence the material is not suitable for forming an engaging type terminal.

SUMMARY OF THE INVENTION

The present invention has been made in view of problems in the related art and it is therefore an object of the present invention to provide a terminal, for an engaging type connector, having an engaging part having a low frictional property, and a solder-bonding part having an improved solder-bonding property on the basis of technical ideas of forming the surface of a base material in a high roughness mentioned in JP-A 2006-77307 and JP-A 2006-183068.

A terminal in a first aspect of the present invention for an engaging type connector includes: a punched Cu alloy strip as a base material; a coating formed on the Cu alloy strip by a postplating process and including a Cu—Sn alloy layer and a Sn layer; wherein the Cu—Sn alloy layer is sandwiched between the base material and the Sn layer, the Sn layer is smoothed by a reflowing process, and the terminal for an engaging type connector has an engaging part and a solder-bonding part, and the surface of a part of the base material corresponding to the engaging part has a surface roughness higher than that of the surface of a part of the base material corresponding to the solder-bonding part.

The base material of the terminal in the first aspect of the present invention for an engaging type connector is subjected to the postplating process. Therefore, the coating including the Cu—Sn alloy layer and the Sn layer coats not only the surface of the Cu alloy strip (the base material), but also edges of punched openings. It is desirable that the surface of a part of the base material corresponding to the engaging part has an arithmetic mean roughness Ra of 0.15 μm or above at least with respect to one direction and an arithmetic mean roughness Ra of 4.0 μm or below with respect to all directions. Usually, the plated layer is formed so as to conform to the irregularities in the surface of the base material and the surface morphology (surface roughness) of the base material is reflected on the surface of the plated layer. The Sn layer formed so as to conform to the irregularities melts and flows and the surface of the Sn layer becomes smooth when the Sn layer is subjected to the reflowing process.

In the terminal in the first aspect of the present invention for an engaging type connector, the coating may further include a Cu layer sandwiched between the Cu—Sn alloy layer and the base material or may further include a Ni layer sandwiched between the Cu—Sn layer and the base material. In the terminal for an engaging type connector, the coating may further include a Cu layer sandwiched between the Ni layer and the Cu—Sn alloy layer.

In the terminal in the first aspect of the present invention for an engaging type connector, it is preferable that the surface of the base material has an arithmetic mean roughness Ra of 0.15 μm or above at least with respect to one direction and an arithmetic mean roughness Ra of 4.0 μm or below with respect to all directions. It is preferable that the surface of a part of the base material corresponding to the engaging part 1 has an arithmetic mean roughness Ra of 0.3 μm or above at least with respect to one direction.

In the terminal in the first aspect of the present invention for an engaging type connector, it is preferable that parts of the Cu—Sn alloy layer corresponding to the engaging part of the terminal are exposed in the surface of the terminal, the areal ratio of the exposed parts of the Cu—Sn alloy layer is between 3% and 75%, and the solder-bonding part is entirely coated with the Sn layer.

In the terminal in the first aspect of the present invention for an engaging type connector, the Cu—Sn alloy layer has a mean thickness between 0.1 and 3.0 μm and has a Cu content between 20 and 70 atomic % and the Sn layer has a mean thickness between 0.2 and 5.0 μm.

In the terminal in the first aspect of the present invention for an engaging type connector, it is preferable that the Cu—Sn alloy layer has a mean thickness between 0.2 and 3.0 μm, the diameter D1 of the smallest circle touching the surface of the Sn layer and the Cu—Sn alloy layer in a section of the engaging part perpendicular to the surface of the engaging part is 0.2 μm or below, the diameter D2 of the largest circle touching the surface of the Sn layer and the Cu—Sn alloy layer in a section of the engaging part perpendicular to the surface of the engaging part is between 1.2 and 20 μm, the height y of the highest point in the surface of the material from the highest point in the surface of the Cu—Sn alloy layer is 0.2 μm or below, and the solder-bonding part is coated entirely with the Sn layer.

In the terminal in the first aspect of the present invention for an engaging type connector, it is preferable that the Ni layer has a mean thickness of 3.0 μm or below, the Cu—Sn alloy layer has a mean thickness between 0.2 and 3.0 μm, the diameter D1 of the smallest circle touching the surface of the Sn layer and the Cu—Sn alloy layer in a section of the engaging part perpendicular to the surface of the engaging part is 0.2 μm or below, the diameter D2 of the largest circle touching the surface of the Sn layer and the Cu—Sn alloy layer in a section of the engaging part perpendicular to the surface of the engaging part is between 1.2 and 20 μm, the height y of the highest point in the surface of the material from the highest point in the surface of the Cu—Sn alloy layer is 0.2 μm or below, and the solder-bonding part is coated entirely with the Sn layer.

In the terminal in the first aspect of the present invention for an engaging type connector, parts of the Cu—Sn alloy layer coated with the Sn layer are exposed when the base material has a high surface roughness and the Sn layer is caused to flow and is smoothed by the reflowing process. It is desirable that the Cu—Sn alloy layer on the solder-bonding part is not exposed and the solder-bonding part is coated entirely with the Sn layer when the Cu—Sn alloy layer on the engaging part is partly exposed. Such a condition can be easily satisfied because the solder-bonding part has a surface roughness lower than that of the engaging part. Another plated Sn layer may be formed after the reflowing process to coat the surface entirely.

A terminal in a second aspect of the present invention for an engaging type connector includes: a punched Cu alloy strip serving as a base material and having an arithmetic mean roughness Ra of 0.15 μm or above with respect to one direction and an arithmetic mean roughness Ra of 4.0 μm or below with respect to all directions; and a coating formed on the base material by postplating processes and including a Cu—Sn alloy layer and a Sn layer; wherein the Cu—Sn alloy layer is sandwiched between the base material and the Sn layer, the Sn layer is smoothed by a reflowing process, the terminal has an engaging part and a solder-bonding part, and a part of the Sn layer on the solder-bonding part has a mean thickness greater than that of a part of the Sn layer on the engaging part.

The base material of the terminal in the second aspect of the present invention for an engaging type connector is subjected to the postplating processes. Therefore, the coating including the Cu—Sn alloy layer and the Sn layer coats not only the surface of the Cu alloy strip (the base material), but also edges of punched openings.

Generally, an ordinary Cu alloy strip (base material) has an arithmetic mean roughness of 0.15 μm or below with respect to all directions. In the second aspect of the present invention, the surface of the base material is formed intentionally in the above-mentioned high arithmetic mean roughness with respect to all directions. Usually, a plated layer forms so as to conform to the irregularities of a base material, and the surface morphology (irregularities) of the surface of base material is reflected on the plated layer. The plated Sn layer is caused to melt and flow and the irregular surface of the Sn layer is smoothed by the reflowing process.

In the terminal in the second aspect of the present invention for an engaging type connector, the respective mean thicknesses of the Ni layer and the Cu layer after the reflowing process, similarly to that of the Cu—Sn alloy layer, are substantially uniform in the engaging part and the solder-bonding part.

In the terminal in the second aspect of the present invention for an engaging type connector, the coating may further include a Cu layer sandwiched between the Cu—Sn alloy layer and the base material or may further include a Ni layer sandwiched between the Cu—Sn layer and the base material.

In the terminal for an engaging type connector, the Cu layer may be sandwiched between the Ni layer and the Cu—Sn alloy layer.

In the terminal in the second aspect of the present invention for an engaging type connector, it is preferable that parts of the Cu—Sn alloy layer corresponding to the engaging part of the terminal are exposed in the surface of the terminal, and the areal ratio of the exposed parts of the Cu—Sn alloy layer is between 3% and 75%, and the solder-bonding part is entirely coated with the Sn layer.

In the terminal in the second aspect of the present invention for an engaging type connector, it is preferable that the Cu—Sn alloy layer has a mean thickness between 0.1 and 3.0 μm and a Cu content between 20 and 70 atomic %, and a part of the Sn layer coating the engaging part has a mean thickness between 0.2 and 5.0 μm.

In the terminal in the second aspect of the present invention for an engaging type connector, it is preferable that a part of the base material corresponding to the engaging part has an arithmetic mean roughness Ra of 3.0 μm or below with respect to all directions.

In the terminal in the second aspect of the present invention for an engaging type connector, it is preferable that a part of the base material corresponding to the engaging part has an arithmetic mean roughness Ra of 0.3 μm or above at least with respect to one direction.

In the terminal in the second aspect of the present invention for an engaging type connector, it is preferable that the Cu—Sn alloy layer has a mean thickness between 0.1 and 3.0 μm, the diameter D1 of the smallest circle touching the surface of the Sn layer and the Cu—Sn alloy layer in a section of the engaging part perpendicular to the surface of the engaging part is 0.2 μm or below, the diameter D2 of the largest circle touching the surface of the Sn layer and the Cu—Sn alloy layer in a section of the engaging part perpendicular to the surface of the engaging part is between 1.2 and 20 μm, and the height y of the highest point in the surface of the material from the highest point in the surface of the Cu—Sn alloy layer is 0.2 μm or below.

In the terminal in the second aspect of the present invention for an engaging type connector, it is preferable that the Ni layer has a mean thickness of 3.0 μm or below, the Cu—Sn alloy layer has a mean thickness between 0.1 and 3.0 μm, the diameter D1 of the smallest circle touching the surface of the Sn layer and the Cu—Sn alloy layer in a section of the engaging part perpendicular to the surface of the engaging part is 0.2 μm or below, the diameter D2 of the largest circle touching the surface of the Sn layer and the Cu—Sn alloy layer in a section of the engaging part perpendicular to the surface of the engaging part is between 1.2 and 20 μm, and the height y of the highest point in the surface of the material from the highest point in the surface of the Cu—Sn alloy layer is 0.2 μm or below.

In the terminal in the second aspect of the present invention for an engaging type connector, the Cu—Sn alloy layer is partly exposed in the surface of the engaging part. Parts of the Cu—Sn alloy layer coated with the Sn layer are exposed when the base material has a high surface roughness and the Sn layer is caused to flow and is smoothed by the reflowing process. It is desirable that the Cu—Sn alloy layer on the solder-bonding part is not exposed when the Cu—Sn alloy layer on the engaging part is partly exposed. Even if the Cu—Sn alloy layer is exposed partly in the solder-bonding part, the degree of exposure of the Cu—Sn alloy layer in the solder-bonding part is less than that in the engaging part because the mean thickness of the Sn layer on the solder-bonding part is greater than that on the engaging part, and hence the solder-bonding property of the solder-bonding part is relatively excellent. When the Cu—Sn alloy layer on the engaging part is exposed partly after the reflowing process, the exposed parts of the Cu—Sn alloy layer may be coated with another Sn layer.

In the terminal having the engaging part and the solder-bonding part in each of the first and the second aspect of the present invention for an engaging type connector, the engaging part has a low frictional property, and the solder-bonding part has an improved solder-bonding property.

In the first aspect of the present invention, since the surface of the part corresponding to the engaging part of the base material is roughened desirably in an arithmetic mean roughness Ra of 0.15 μm or above at least with respect to one direction and in an arithmetic mean roughness Ra of 4.0 μm or below with respect to all directions, parts of the Cu—Sn alloy layer corresponding to the projections of the irregular surface of the base material are exposed or parts of the Sn layer corresponding to the projections in the roughened surface of the base material are very thin. Therefore, the engaging part has a low frictional property as compared with the ordinary material entirely coated with a Sn layer having a substantially uniform thickness even if the mean thickness is the same. The part corresponding to the solder-bonding part of the base material has a surface roughness as low as that of an ordinary Cu—Sn alloy layer alloy strip having an arithmetic mean roughness below 0.15 μm with respect to all directions and is coated entirely with the Sn layer having a substantially uniform thickness and hence the solder-bonding part is excellent in solder-bonding property.

According to the second aspect of the present invention, the Sn layer is the outermost layer, and the Cu—Sn alloy layer having a high hardness underlies the Sn layer. Since the mean thickness of the part corresponding to the solder-bonding part of the Sn layer is greater than that of the part corresponding to the engaging part of the Sn layer, the solder-bonding part has a relatively improved solder-bonding property. Since the part corresponding to the engaging part of the Sn layer is thin, the engaging part has a relatively improved frictional property. Particularly, the Cu—Sn alloy layer alloy strip, namely, the base material, has a surface roughness represented by an arithmetic mean roughness Ra of 0.15 μm or above at least with respect to one direction and an arithmetic mean roughness Ra of 4.0 μm or below with respect to all directions, and higher than that of an ordinary Cu—Sn alloy layer alloy strip, parts of the Cu—Sn alloy layer corresponding to the projections in the surface of the part corresponding to the engaging part of the base material are exposed or parts of the Sn layer corresponding to the projections in the surface of the part corresponding to the engaging part of the base material are thin, and the engaging part has a low frictional property. The mean thickness of the part corresponding of the solder-bonding part is greater than that of part corresponding to the engaging part, and the solder-bonding part is excellent in solder-bonding property. The solder bonding part is particularly excellent in solder-bonding property when the solder-bonding part is coated entirely with the Sn layer.

DETAILED DESCRIPTION OF THE PREFERRED EMBODIMENTS

First Embodiment

A terminal in a first embodiment according to the present invention for an engaging type connector and a method of manufacturing the same will be described with reference to FIGS. 1 to 6.

The terminal, which is assumed to be a pin terminal for a printed wiring board, is manufactured by the following steps.

Figure 1:
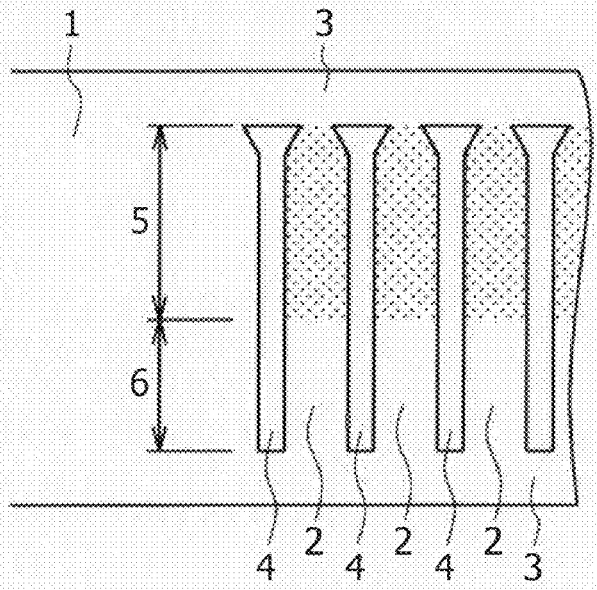
FIG. 1 is a view of assistance in explaining a method of manufacturing a terminal in a first embodiment according to the present invention for an engaging type connector.

(1) Referring to FIG. 1, a normally rolled Cu alloy strip 1 is subjected to a punching process by a progressive die to form longitudinally arranged terminal bodies 2 connected by connecting parts 3. Indicated at 4 are openings formed by the punching process.

Figure 2:
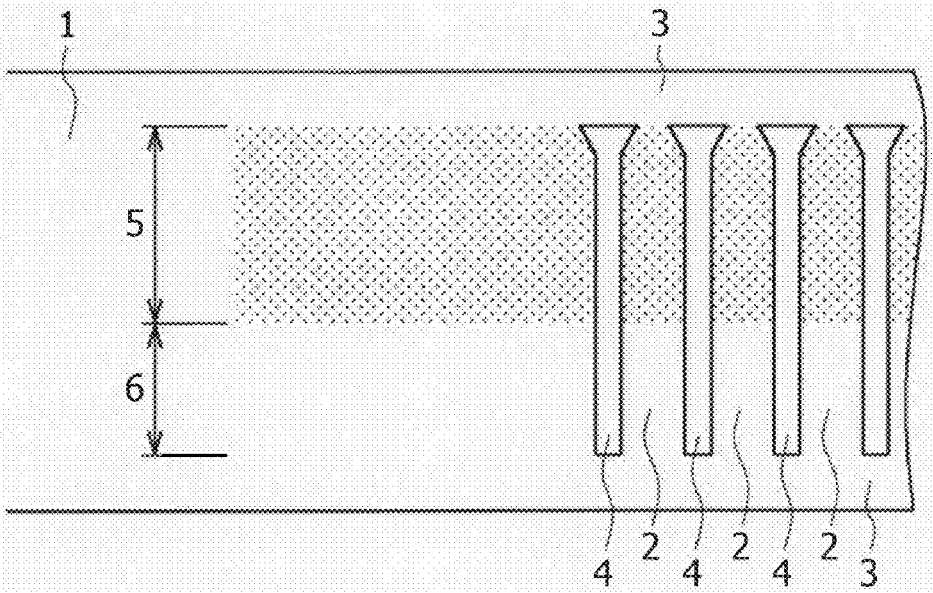
FIG. 2 is a view of assistance in explaining a method of manufacturing the terminal in the first embodiment for an engaging type connector.
Figure 3:
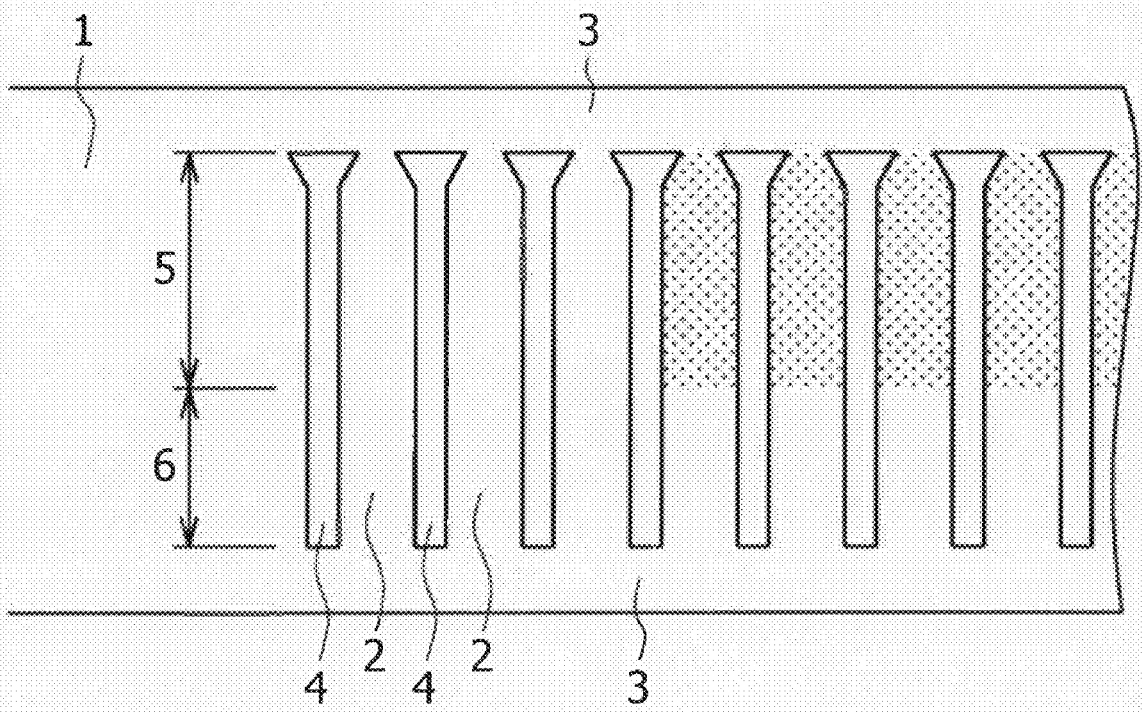
FIG. 3 is a view of assistance in explaining a method of manufacturing the terminal in the first embodiment for an engaging type connector.

The surfaces of engaging parts 5 of the terminal bodies 2 are roughened by press work concurrently with the punching process. In FIG. 1, parts shaded by small dots are engaging parts 5 having the rough surfaces. The surface roughness of solder-bonding parts 6 of the terminal bodies 2 are the same as the original surface roughness of the Cu alloy strip 1. The press work is executed before the Cu strip 1 is subjected to the punching process as shown in FIG. 2 or after the Cu strip 1 has been subjected to the punching process as shown in FIG. 3.

(2) The entire surface of the Cu alloy strip 1 is plated by a postplating process. In this embodiment, the post plating process includes a Ni plating process, a Cu plating process and a Sn plating process. The entire surface of the terminal bodies 2 including the engaging parts 5 and the solder-bonding parts 6 are plated uniformly. Basically, the engaging parts 5 and the solder-bonding parts 6 are the same in the respective mean thicknesses of a plated Ni layer, a plated Cu layer and a plated Sn layer.

(3) Subsequently, the Cu alloy strip is subjected to a reflowing process. Basically, the engaging parts 5 and the solder-bonding parts 6 are the same in the respective mean thicknesses of a Ni layer, a Cu layer, if any part thereof remains, and a Cu—Sn alloy layer and a Sn layer after the reflowing process.

(4) The Cu alloy strip is subjected to a flush plating process to form a thin Sn layer over the surface thereof in case of need.

(5) The terminal bodies 2 are cut off the connecting parts 3 after subjecting the terminal bodies 2 to a forming process when necessary.

Figure 4A:
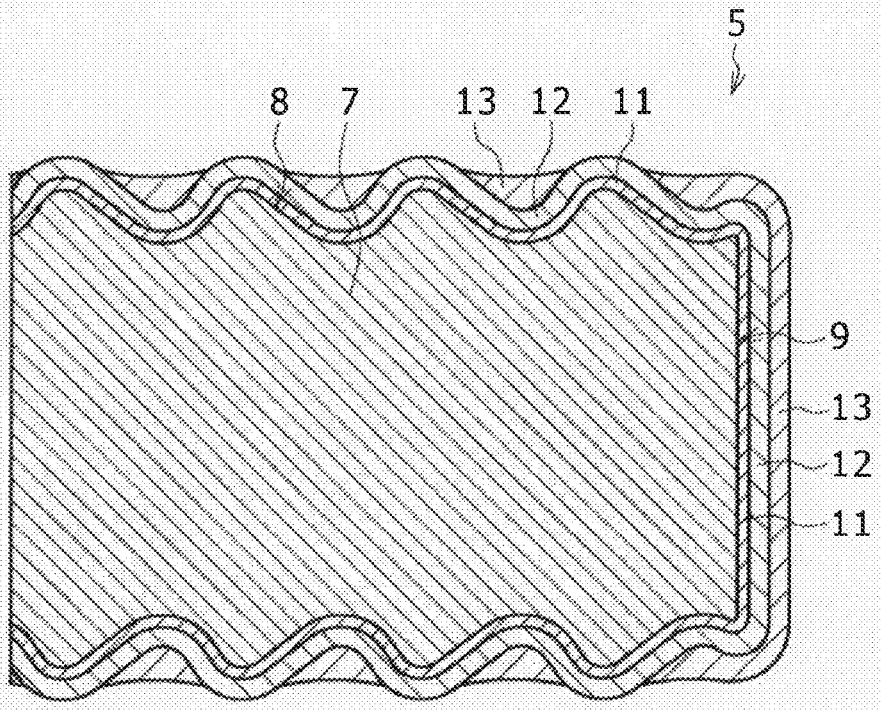
FIGS. 4A and 4B are typical cross-sectional views of an engaging part and a solder-bonding part, respectively, of the terminal in the first embodiment for an engaging type connector.
Figure 4B:
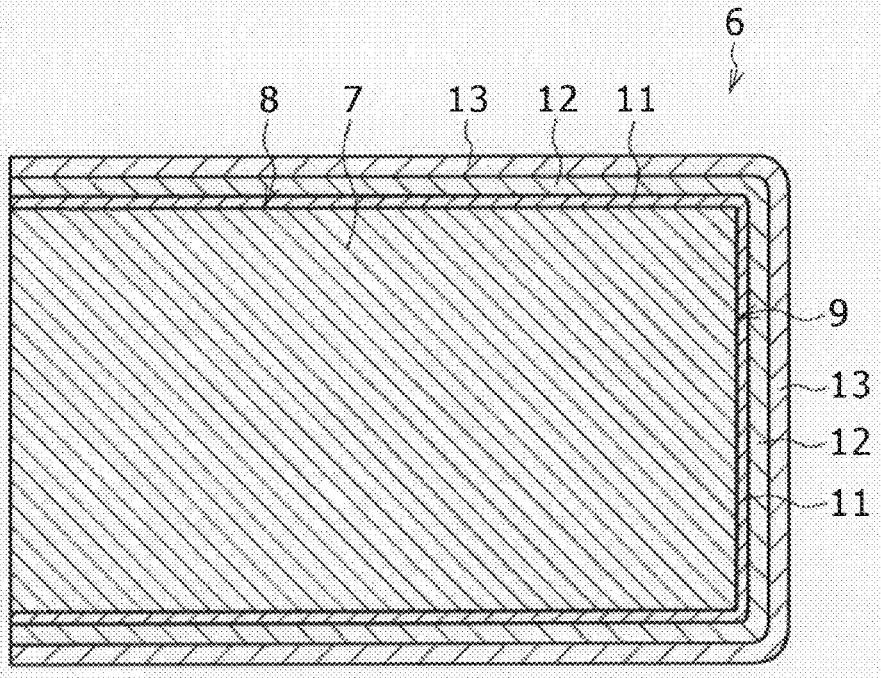

FIGS. 4A and 4B are typical cross-sectional views of an engaging part 5 and a solder-bonding part 6, respectively, of the terminal body 2 processed by the Ni, Cu and Sn plating processes, and the reflowing process. In this embodiment, the plated Cu layer and the plated Sn layer fuse together to form a Cu—Sn alloy layer and the plated Cu layer disappears when the Cu alloy strip is subjected to the reflowing process. Usually, the surface morphology of a base material is reflected on the shape of the Cu—Sn alloy layer formed between the plated Cu layer and the molten plated Sn layer.

A part of the surface 8 corresponding to the engaging part 5 of a base material 7 is roughened to form irregularities. A coating including a Ni layer 11, a Cu—Sn alloy layer 12 and a Sn layer 13 is formed on the irregular surface 8. The Ni layer 11 and the Cu—Sn alloy layer 12 are formed so as to conform to irregularities in the surface 8. The reflowing process melts the Sn layer 13 and makes the molten Sn layer 13 flow to smooth the Sn layer 13. Parts of the Cu—Sn alloy layer 12 corresponding to projections in the irregular surface 8 are exposed. Since the coating is formed by a postplating process, the Ni layer 11, the Cu—Sn alloy layer 12 and the Sn layer 13 are formed also on edges 9 of openings formed in the base material 7.

The Ni layer 11, the Cu—Sn alloy layer 12 and the Sn layer 13 are formed on a part of the surface 8 corresponding to the solder-bonding part 6 of the base material 7, similarly to that corresponding to the engaging part 5. Since the part of the surface 8 corresponding to the solder-bonding part 6 has a surface roughness corresponding to that of an ordinary Cu alloy strip, any parts of the Cu—Sn alloy layer 12 are not exposed and the Cu—Sn alloy layer 12 is coated entirely with the Sn layer 13. Similarly, the Ni layer 11, the Cu—Sn alloy layer 12 and the Sn layer 13 are formed also on edges 9 of openings formed in the base material 7.

In a terminal, for an engaging type connector, obtained by thus processing the terminal body 2, the Sn layer 13 is the outermost layer of the coating formed on the engaging part 5 and the Cu—Sn alloy layer 12 having a high hardness is partly exposed. Therefore, the terminal has high electrical reliability and a low frictional property. Since the surface of the solder-bonding part 6 and edges of the openings are coated entirely with the Sn layer 13, the solder-bonding part 6 is excellent in solder-bonding property.

Figure 5A:
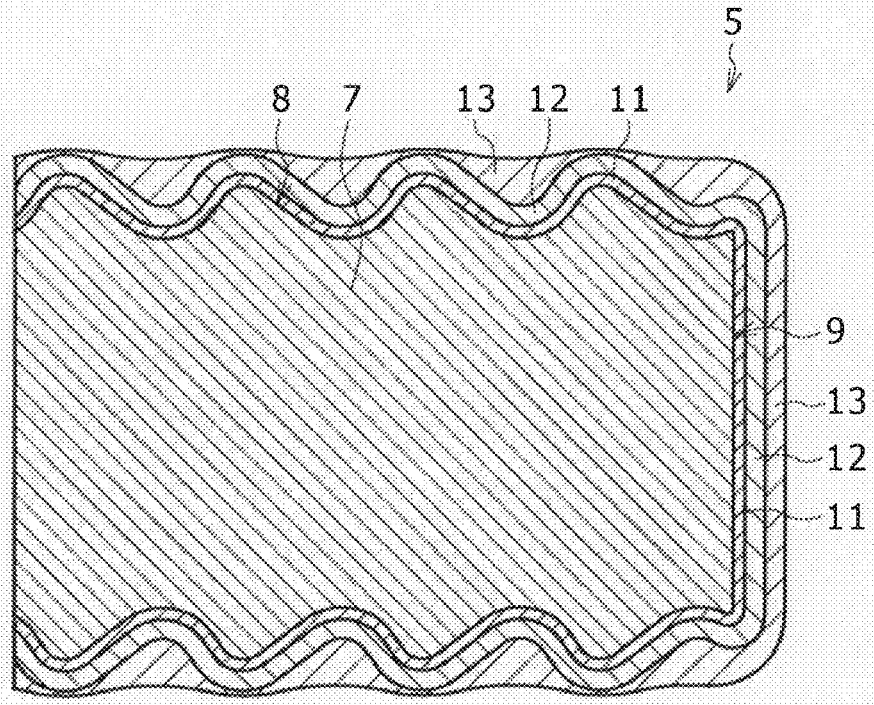
FIGS. 5A and 5B are typical cross-sectional views of an engaging part and a solder-bonding part, respectively, of a terminal in the first embodiment for an engaging type connector.
Figure 5B:
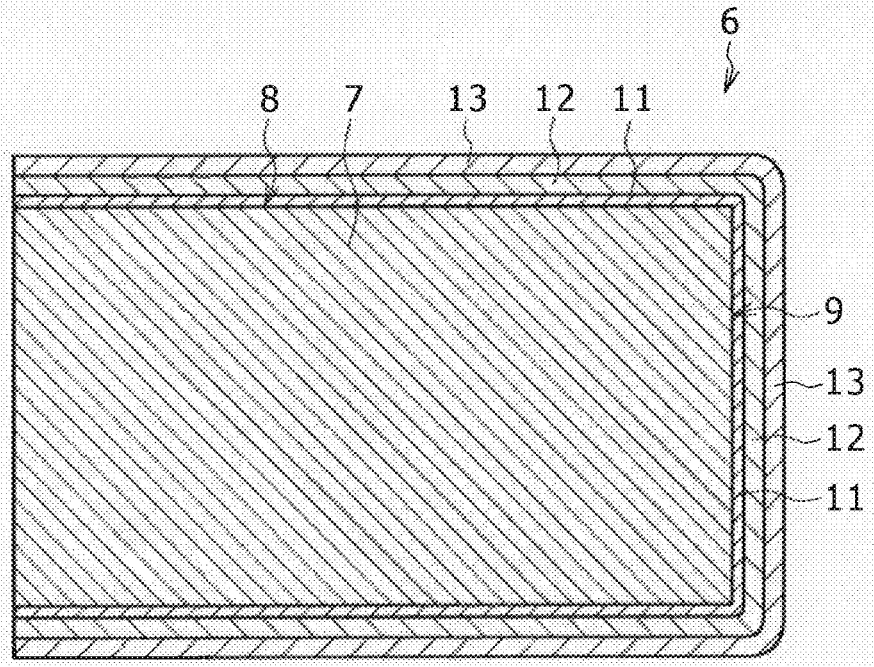

FIGS. 5A and 5B are typical cross-sectional views of an engaging part and a solder-bonding part, respectively, of another terminal obtained by processing a terminal body by Ni, Cu and Sn plating processes, and a reflowing process. In the terminal shown in FIG. 5, a plated Cu layer and a plated Sn layer are fused together to form a Cu—Sn alloy layer and the plated Cu layer disappears when the Cu alloy strip is subjected to the reflowing process. In FIG. 5, parts like or corresponding to those shown in FIG. 4 are designated by the same reference characters, respectively.

The terminal shown in FIG. 5 differs from that shown in FIG. 4 only in that any parts of the Cu—Sn alloy layer 12 are not exposed on the surface of the Sn layer 13. However, the surface of the Cu—Sn alloy layer 12 has an irregular shape corresponding to the irregular surface 8 of the base material. The respective thicknesses of parts of the Sn layer 13 corresponding to projections in the surface 8 are considerably smaller than the mean thickness of a part of the Sn layer 13 on the engaging part 5. The surface and edges of a solder-bonding part 7, similarly to those of the solder-bonding part shown in FIG. 4 are coated entirely with the Sn layer 13 having a substantially uniform thickness.

In a terminal, for an engaging type connector, obtained by processing this terminal body 2, the Sn layer 13 is the outermost layer of the coating formed on the engaging part 5 and the Cu—Sn alloy layer 12 has an irregular shape corresponding to the irregularities in the surface 8 of the base material, the parts of the Sn layer 13 corresponding to the projections are thin and the Cu—Sn alloy layer 12 having a high hardness lies near the surface of the material. Therefore, the terminal has high electrical reliability and a low frictional property. Since the surface and edges of the solder-bonding part 6 are coated entirely with a part of the Sn layer 13 having a thickness greater than those of the parts of the Sn layer 13 corresponding to the projections, the solder-bonding part 6 is excellent in solder-bonding property.

Figure 6A:
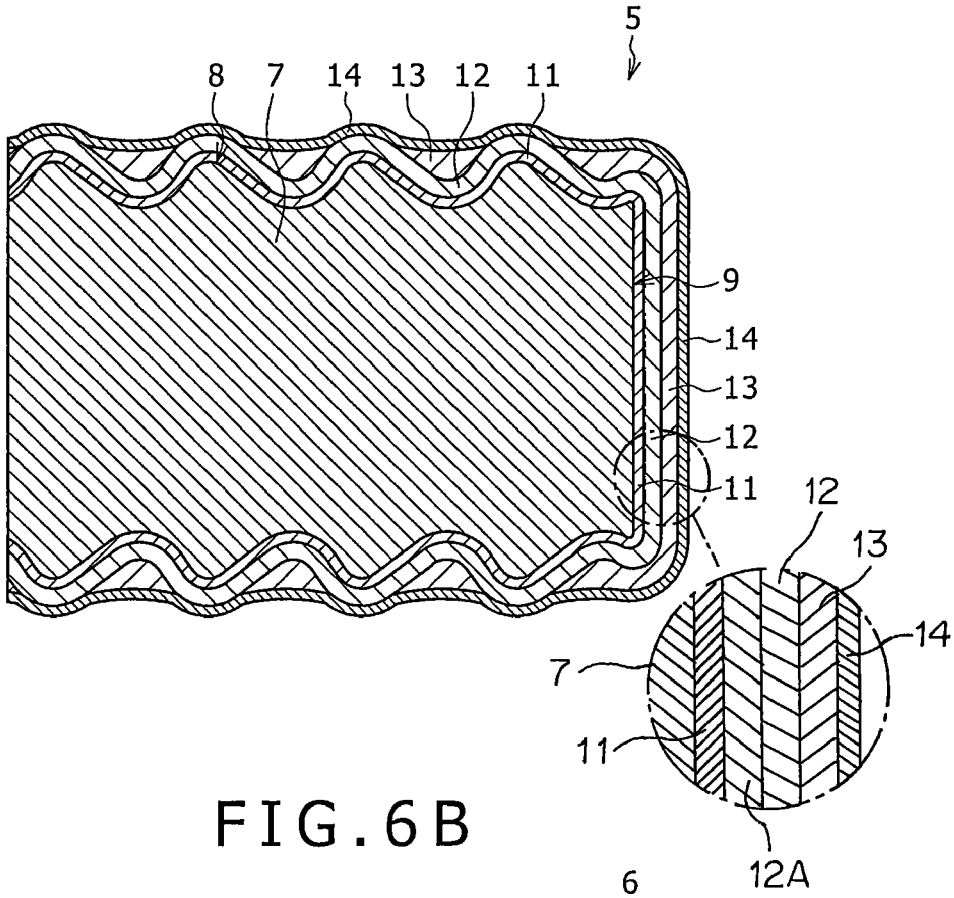
FIGS. 6A and 6B are typical cross-sectional views of an engaging part and a solder-bonding part, respectively, of a terminal in the first embodiment for an engaging type connector.
Figure 6B:
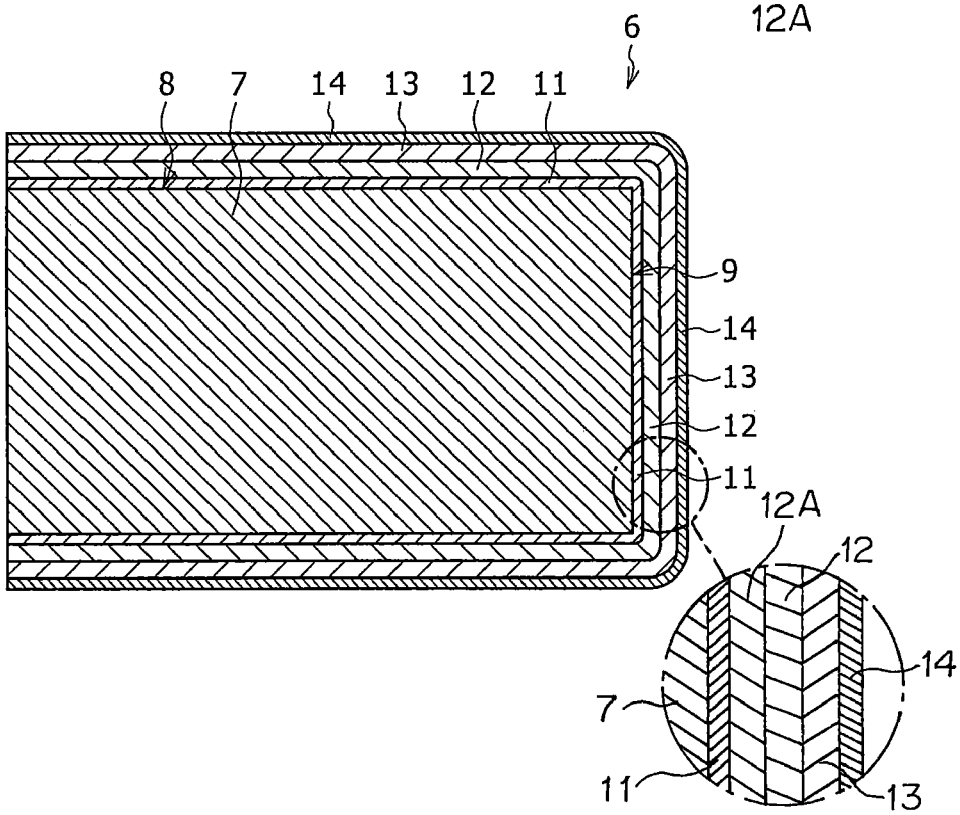

FIGS. 6A and 6B are typical cross-sectional views of an engaging part and a solder-bonding part, respectively, of a terminal body formed by sequentially subjecting a Cu alloy strip to Ni, Cu and Sn plating processes, a reflowing process and a Sn plating process in that order. In this example, a plated Cu layer and a plated Sn layer form a Cu—Sn alloy layer when subjected to the reflowing process. In FIG. 6, parts like or corresponding to those shown in FIG. 4 are designated by the same reference characters.

Referring to FIG. 6, a base material 7, a Ni layer 11, a Cu—Sn alloy layer 12 and Sn layer 13 forming an engaging part 5 and a solder-bonding part 6 are identical to those shown in FIG. 4. Another Sn layer 14 is formed over the Sn layer 13 after the reflowing process. The Sn layer 14 covers parts of the Cu—Sn alloy layer 12 on the engaging part 5 caused to be exposed by the reflowing process and the Sn layer entirely substantially uniformly.

The engaging part 5 of a terminal, for an engaging type connector, obtained by processing this terminal body 2 is coated with the Sn layers, namely, the Sn layers 13 and 14, the Cu—Sn alloy layer 12 has irregularities corresponding to those in the surface 8 of the base material, parts of the Sn layer (the Sn layer 14) corresponding to projections in the Cu—Sn alloy layer 12 are relatively thin, and the Cu—Sn alloy layer 12 having a high hardness lies near the surface of the material. Therefore, the engaging part has high electrical reliability and a low frictional property. The parts of the Sn layers, namely, the Sn layers 13 and 14, coating the solder-bonding part 6 are thicker than those corresponding to the projections. Therefore, the solder-bonding part 6 is excellent in solder-bonding property. Actually, there is no boundary between the Sn layers, namely, the Sn layers 13 and 14, and the Sn layers, namely, the Sn layers 13 and 14, can be hardly distinguished from each other.

When the plated Cu layer remains in the engaging part 5 and the solder-bonding part 6 shown in FIGS. 4 to 6 after the reflowing process, the Cu layer 12A (shown in the detail of FIGS. 6(*a*)-6(*b*)) exists between the Ni layer 11 and the Cu—Sn alloy layer 12. When a plated Cu layer is formed as a base coat under the plated Ni layer, a base Cu layer underlies the Ni layer 12. When Ni plating is omitted, the coating includes the Cu—Sn alloy layer 12 and the Sn layer 13. When the plated Cu layer remains after the reflowing process, the Cu layer exists between the base material 7 and the Cu—Sn alloy layer 12.

Both the surfaces of the part of the Cu alloy strip, namely, the base material 7, corresponding to the engaging part 5 are roughened by the press work in the foregoing embodiment; only one of those surfaces may be roughened and the other surface may be left not roughened.

The surface roughness of the part of the base material 7 corresponding to the engaging part 5 shown in FIG. 4A, the structure of the coating, and the method of manufacturing the same will be described later.

In the solder-bonding part 6 shown in FIG. 4B, the base material 7 may have a surface roughness lower than that of the part of the base material 7 corresponding to the engaging part, more specifically, a surface roughness corresponding to that of an ordinary Cu alloy strip, such as an arithmetic mean roughness Ra below 0.15 μm with respect to all directions, the coating may be of the ordinary structure, in which the component layers of the coating including the Sn layer have substantially uniform thicknesses, respectively.

The surface roughness of the part of the base material 7 corresponding to the engaging part 5 shown in either of FIGS. 5A and 6A, the structure of the coating, and the method of manufacturing the same will be described later.

The part of the base material 7 corresponding to the solder-bonding part 6 shown in either of FIGS. 5B and 6B, similarly to the part of the base material 7 corresponding to the solder-bonding part 6 shown in FIG. 4B, may have a surface roughness lower than that of the part of the base material 7 corresponding to the engaging part 5, more specifically, a surface roughness corresponding to that of an ordinary Cu alloy strip, such as an arithmetic mean roughness Ra below 0.15 μm with respect to all directions, the coating may be of the ordinary structure, in which the component layers of the coating including the Sn layer have substantially uniform thicknesses, respectively.

Second Embodiment

A terminal in a second embodiment according to the present invention for an engaging type connector and a method of manufacturing the same will be described with reference to FIGS. 11 to 13, in which parts like or corresponding to those of the first embodiment are designated by the same reference characters.

The terminal, which is assumed to be a pin terminal for a printed wiring board, is manufactured by the following steps.

Figure 11A:
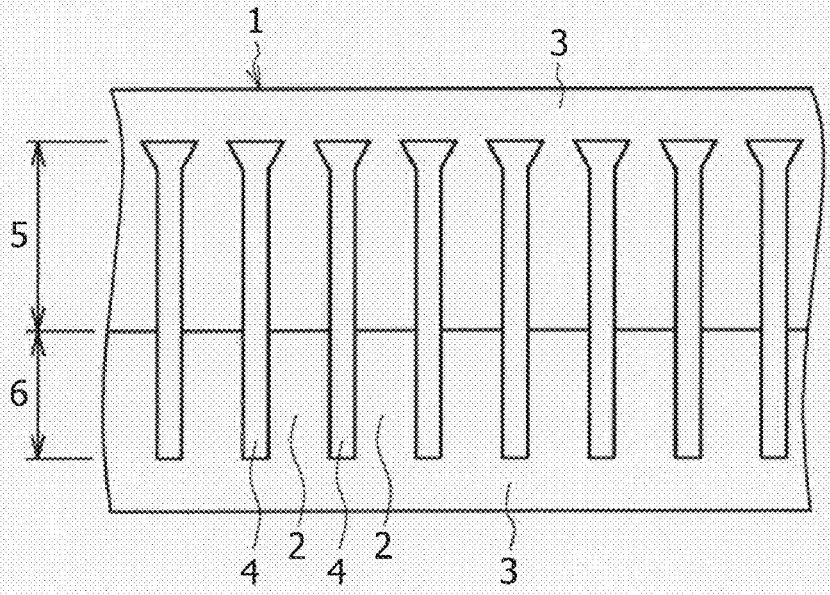
FIG. 11 is a view of assistance in explaining a method of manufacturing a terminal in a second embodiment according to the present invention for an engaging type connector.

(1) Referring to FIG. 11A, a Cu alloy strip 1 is subjected to a punching process to form longitudinally arranged terminal bodies 2 connected by connecting parts 3. The surface of the Cu alloy strip 1 has an arithmetic mean roughness Ra of 0.15 μm or above at least with respect to one direction and an arithmetic mean roughness Ra of 4.0 μm or below with respect to all directions. Indicated at 4 are openings formed by the punching process. FIG. 11A shows the Cu alloy strip 1 in a state after a postplating process.

Figure 11B:
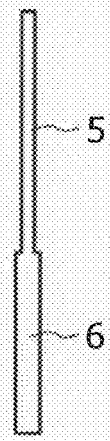

(2) The entire surface of the Cu alloy strip 1 is plated by a postplating process. In this embodiment, the post plating process includes a Ni plating process, a Cu plating process and a Sn plating process. The entire surface of the Cu alloy strip 1 including engaging parts 5 and solder-bonding parts 6 is plated by the Ni and the Cu plating process. Basically, the engaging parts 5 and the solder-bonding parts 6 are the same in the respective mean thicknesses of the plated layers. A part of the plated Sn layer corresponding to the engaging parts 5 of the Cu alloy strip 1 is thin and that of the plated Sn layer corresponding to the solder-bonding parts 6 is thick. FIG. 11B is a typical cross-sectional view of the plated Cu alloy strip 1.

(3) Subsequently, the Cu alloy strip is subjected to a reflowing process. Basically, the engaging parts 5 and the solder-bonding parts 6 are the same in the respective mean thicknesses of a Ni layer, a Cu layer, if any part thereof remains, and a Cu—Sn alloy layer and a Sn layer after the reflowing process. The thickness of the original Sn layer is reflected on the Sn layer; a part of the Sn layer corresponding to the engaging parts 5 of the Cu alloy strip 1 has a small mean thickness and a part of the same corresponding to the solder-bonding parts 6 has a big mean thickness.

(4) The terminal bodies 2 are cut off the connecting parts 3 after subjecting the terminal bodies 2 to a forming process when necessary.

Figure 12A:
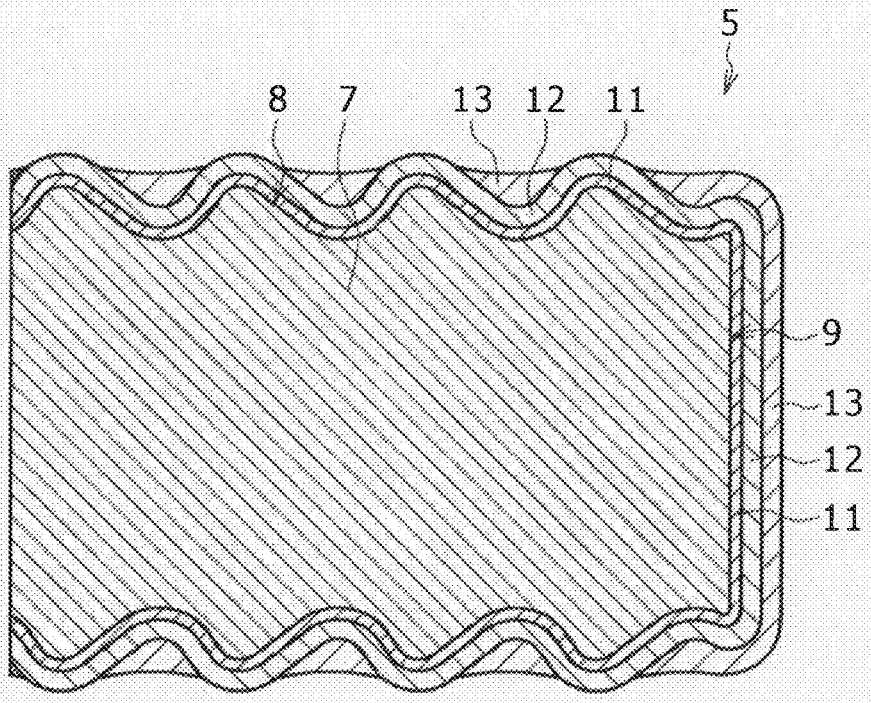
FIGS. 12A and 12B are typical cross-sectional views of an engaging part and a solder-bonding part, respectively, of the terminal in the second embodiment for an engaging type connector.
Figure 12B:
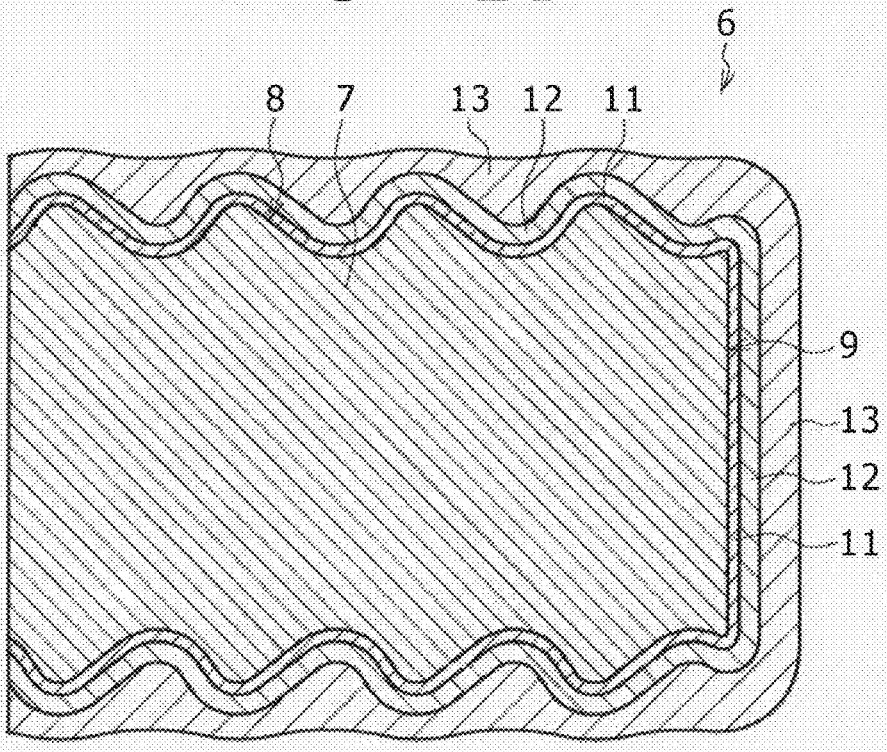

FIGS. 12A and 12B are typical cross-sectional views of an engaging part 5 and a solder-bonding part 6, respectively, of the terminal body 2 processed by the Ni, Cu and Sn plating processes, and the reflowing process. The Cu alloy strip employed in this embodiment is rolled such that the Cu alloy strip has a surface roughness greater than that of ordinary Cu alloy strips. A plated Cu layer and a plated Sn layer form a Cu—Sn alloy layer and the plated Cu layer disappears when the Cu alloy strip is subjected to the reflowing process. Usually, the surface morphology of a base material is reflected on the shape of the Cu—Sn alloy layer formed between the plated Cu layer and the molten plated Sn layer.

A part of the surface 8 corresponding to the engaging part 5 of the base material 7 is roughened to form irregularities. A coating including a Ni layer 11, a Cu—Sn alloy layer 12 and a Sn layer 13 is formed on the irregular surface 8. The Ni layer 11 and the Cu—Sn alloy layer 12 are formed so as to conform to irregularities in the surface 8. The reflowing process melts the Sn layer 13 and makes the molten Sn layer 13 flow to smooth the Sn layer 13. Parts of the Cu—Sn alloy layer 12 corresponding to projections in the irregular surface 8 are exposed. Since the coating is formed by a postplating process, the Ni layer 11, the Cu—Sn alloy layer 12 and the Sn layer 13 are formed also on edges 9 of openings formed in the base material 7.

Part of the surface 8 of the base material 7 corresponding to the solder-bonding part 6, similarly to that corresponding to the engaging part 5, is roughened and is coated with the coating including the Ni layer 11, the Cu—Sn alloy layer 12 an the Sn layer 13. Since the Sn layer 13 is thick, any parts of the Cu—Sn alloy layer 12 are not exposed and the Sn layer 13 coats the surface of the solder-bonding part 6 entirely. Similarly, the Ni layer 11, the Cu—Sn alloy layer 12 and the Sn layer 13 are formed also on edges 9 of the openings. The respective thicknesses of parts of the Ni layer 11 and the Cu—Sn alloy layer 12 corresponding to the solder-bonding part 6 are substantially the same as those corresponding to the engaging part 5.

In a terminal, for an engaging type connector, obtained by thus processing the terminal body 2, the Sn layer 13 is the outermost layer of the coating formed on the engaging part 5 and the Cu—Sn alloy layer 12 having a high hardness is partly exposed. Therefore, the terminal has high electrical reliability and a low frictional property. Since the surface of the solder-bonding part 6 and edges of the openings are coated entirely with the Sn layer 13 having a comparatively big mean thickness, the solder-bonding part 6 is excellent in solder-bonding property.

Figure 13A:
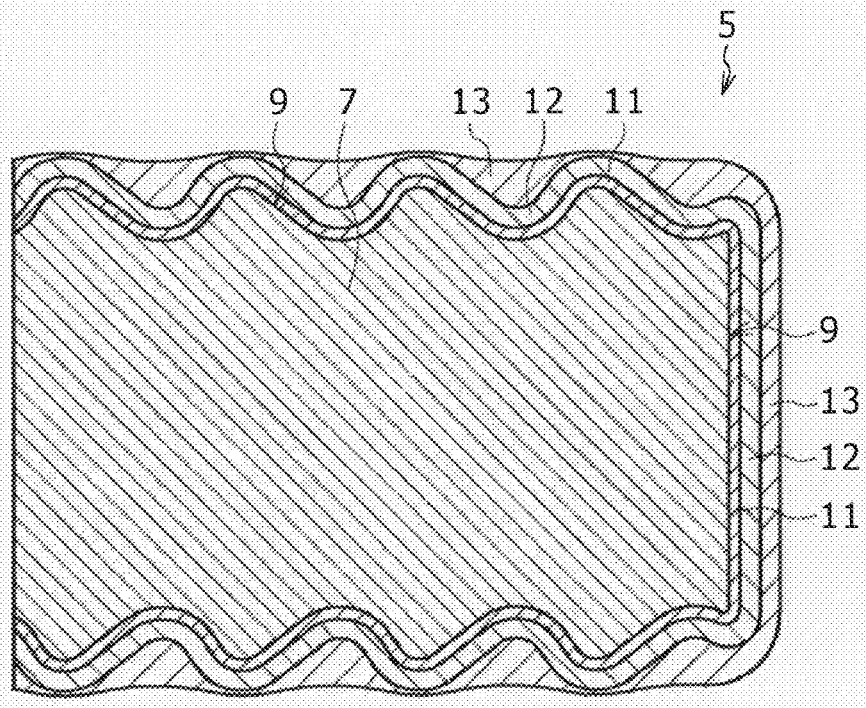
FIGS. 13A and 13B are typical cross-sectional views of an engaging part and a solder-bonding part, respectively, of the terminal in the second embodiment for an engaging type connector.
Figure 13B:
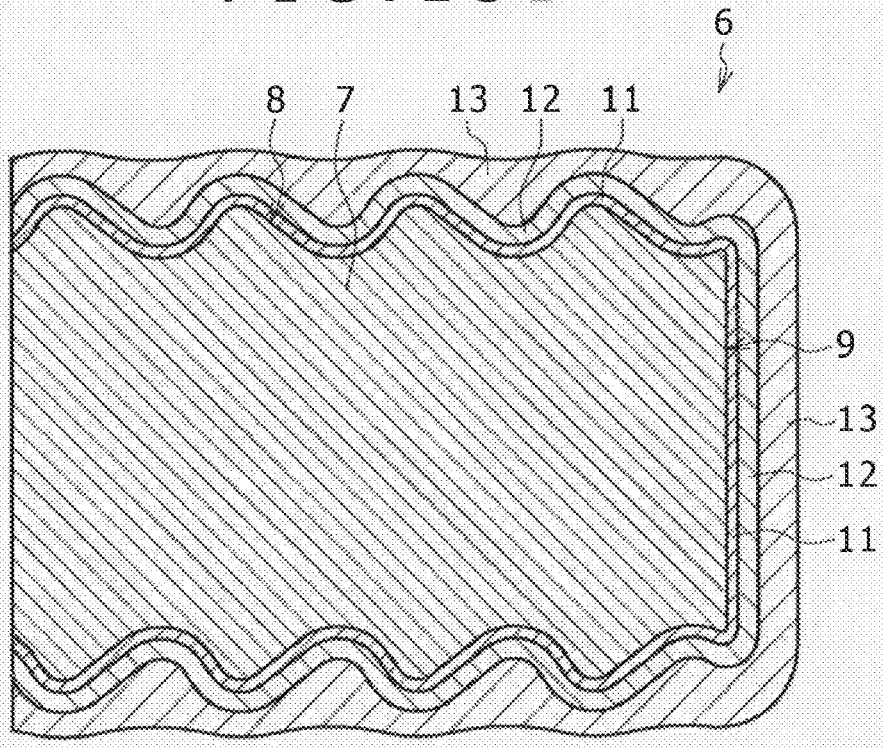

FIGS. 13A and 13B are typical cross-sectional views of an engaging part and a solder-bonding part, respectively, of another terminal obtained by processing a terminal body by Ni, Cu and Sn plating processes, and a reflowing process. A rolled Cu alloy strip having a surface roughness higher than that of a normal Cu alloy strip is used. A plated Cu layer and a plated Sn layer are fused together to form a Cu—Sn alloy layer and the plated Cu layer disappears when the Cu alloy strip is subjected to the reflowing process. In FIG. 13, parts like or corresponding to those shown in FIG. 12 are designated by the same reference characters, respectively.

The terminal shown in FIG. 13 differs from that shown in FIG. 12 only in that any parts of the Cu—Sn alloy layer 12 corresponding to an engaging part 5 are not exposed on the surface of the Sn layer 13. However, the surface of the Cu—Sn alloy layer 12 has an irregular shape corresponding to the irregular surface 8 of the base material. The respective mean thicknesses of parts of the Sn layer 13 corresponding to projections in the surface 8 are considerably smaller than the mean thickness of the Sn layer 13.

A solder-bonding part 7 is the same as that shown in a cross-sectional view in FIG. 12. The Cu—Sn alloy layer 12 having irregularities corresponding to those of the surface 8 of the base material is coated entirely with the Sn layer 13. Parts of the Sn layer 13 corresponding to protrusions of the irregularities are comparatively thick. The respective mean thicknesses of the Ni layer 11 and the Cu—Sn alloy layer 12 are approximately equal to those of the parts of the Ni layer 11 and the Cu—Sn alloy layer 12 on the engaging part 5, respectively.

In a terminal, for an engaging type connector, obtained by thus processing the terminal body 2, the Sn layer 13 is the outermost layer of the coating formed on the engaging part 5 and the Cu—Sn alloy layer 12 has an irregular shape corresponding to the irregularities in the surface 8 of the base material, the parts of the Sn layer 13 corresponding to the projections are thin and the Cu—Sn alloy layer 12 having a high hardness lies near the surface of the material. Therefore, the terminal has high electrical reliability and a low frictional property. Since the surface of the solder-bonding part 6 and edges of the openings are coated entirely with a part of the Sn layer 13 having a thickness greater than that of the part of the Sn layer 12 on the engaging part 5, the solder-bonding part 6 is excellent in solder-bonding property.

When the plated Cu layer remains in the engaging part 5 and the solder-bonding part 6 shown in either of FIGS. 12 and 13 after the reflowing process, the Cu layer exists between the Ni layer 11 and the Cu—Sn alloy layer 12. When a plated Cu layer is formed as a base coat under the plated Ni layer, a base Cu layer underlies the Ni layer 12. When Ni plating is omitted, the coating includes the Cu—Sn alloy layer 9 and the Sn layer 11. When the plated Cu layer remains after the reflowing process, the Cu layer exists between the base material 7 and the Cu—Sn alloy layer 9.

Both the surfaces of the Cu alloy strip shown in either of FIGS. 12 and 13 are roughened. A Cu alloy strip, in which one of the surfaces thereof has a high roughness and the other surface has an ordinary roughness, such as an arithmetic mean roughness of 0.15 μm or below with respect to all directions, may be used.

The surface roughness of the part of the surface 8 of the base material 7 corresponding to the engaging part 5 shown in FIG. 12A, the structure of the coating, and the method of manufacturing the same will be described later.

A part of the base material 7 corresponding to the solder-bonding part 6 shown in FIG. 12B is the same as a part of the same corresponding to the engaging part 5. A part of the Sn layer on the solder-bonding part 6 is thicker than that of the Sn layer on the remains after the reflowing process. Desirably, the surface is coated entirely with the Sn layer 13 as shown in FIG. 12B. Note that the desirable mean thickness of the part of the Sn layer 13 on the solder-bonding part 6 is above 0.5 μm.

The surface roughness of the part of the base material 7 corresponding to the engaging part 5 shown in FIG. 13A, the structure of the coating, and the method of manufacturing the same will be described later.

A part of the base material 7 corresponding to the solder-bonding part 6 shown in FIG. 13B is the same as a part of the same corresponding to the engaging part 6. A part of the Sn layer on the solder-bonding part 6, similarly to the part of the plated Sn layer on the solder-bonding part 6 shown in FIG. 12B, is thick, and the Sn layer 13 after the reflowing process is thick. Desirably, the surface is coated entirely with the Sn layer 13 as shown in FIG. 12B. Desirably, the mean thickness of the part of the Sn layer 13 on the solder-bonding part 6 is above 0.5 μm as mentioned in JP-A 2004-68026.

A method of manufacturing either of the first and the second embodiment uses a Cu alloy strip having a surface roughness higher than that of an ordinary Cu alloy strip as a base material, forms a plated Ni layer, a plated Cu layer and a plated Sn layer in that order or a plated Cu layer and a plated Sn layer in that order on the base material, or forms only a plated Sn layer on the base material, and processes the plated Sn layer by the reflowing process to form a Cu—Sn alloy layer by the plated Cu layer (Cu is supplied from the Cu alloy base material if a plated Ni layer is not formed) and the plated Sn layer or by the Cu alloy base material and the plated Sn layer and to smooth the plated Sn layer such that the Cu—Sn alloy layer is exposed partly in the surface, in which parts of the Cu—Sn alloy layer corresponding to projections in irregularities formed in the surface of the base material are exposed.

Concrete matters common to the first and the second embodiment will be described. The surface of the base material has an arithmetic mean roughness Ra of 0.15 μm or above at least with respect to one direction and an arithmetic mean roughness Ra of 4.0 μm or below with respect to all directions. Desirably, the respective mean thicknesses of the plated Ni layer, the plated Cu layer, the plated Sn layer are 3.0 μm or below, 1.5 μm or below (between 0.1 and 1.5 μm when a plated Ni layer is formed) and between 0.3 to 8.0 μm, respectively, and the mean of intervals between the irregularities with respect to one direction is between 0.01 and 0.5 mm. A plated Ni layer as a base coat may be formed. When a plated Ni layer is formed, it is desirable that the mean thickness of a plated Cu layer as a base coat is between 0.01 and 1 μm.

In a state after the reflowing process, the Cu—Sn alloy layer has an areal exposure ratio between 3% and 75%, a mean thickness between 0.1 and 3.0 μm and a Cu content between 20 and 70 atomic % and the Sn layer has a mean thickness between 0.2 and 5.0 μm. It is desirable that the surface of the base material has an arithmetic mean roughness Ra of 0.15 μm or above at least with respect to one direction and an arithmetic mean roughness Ra of 4.0 μm or below with respect to all directions, intervals of the exposed parts of the Cu—Sn alloy layer are between 0.01 and 0.5 mm at least with respect to one direction, and the respective mean thicknesses of the Ni layer and the Cu layer are 3 μm or below and 3.0 μm or below, respectively. Desirably, the mean thickness of the Cu layer is 1.0 μm or below. When a plated Cu layer is formed as a base coat, a base Cu layer having a mean thickness between 0.01 and 1 μm underlies the Ni layer.

Concrete matters common to the first and the second embodiment will be described. The surface of the base material has an arithmetic mean roughness Ra of 0.3 μm or above at least with respect to one direction and an arithmetic mean roughness Ra of 4.0 μm or below with respect to all directions. Desirably, the calculated mean interval Sm of the intervals of the irregularities with respect to one direction is between 0.01 and 0.5 mm, and the respective mean thicknesses of the plated Ni layer, the plated Cu layer and the plated Sn layer are 3.0 μm or below, 1.5 μm or below (between 0.1 and 1.5 μm when a plated Ni layer is formed) and between 0.4 and 8.0 μm, respectively. A plated Ni layer as a base coat may be formed. When a plated Ni layer is formed, it is desirable that the mean thickness of a plated Cu layer as a base coat is between 0.01 and 1 μm.

In a state after the reflowing process, the Cu—Sn alloy layer has an areal exposure ratio between 3% and 75%, a mean thickness between 0.2 and 3.0 μm and a Cu content between 20 and 70 atomic %, and the Sn layer has a mean thickness between 0.2 and 5.0 μm and the surface of the material has an arithmetic mean roughness Ra of 0.15 μm or above at least with respect to one direction and an arithmetic mean roughness Ra of 3.0 μm or below with respect to all directions. It is desirable that the surface of the base material has an arithmetic mean roughness Ra of 0.3 μm or above at least with respect to one direction and an arithmetic mean roughness Ra of 4.0 μm or below with respect to all directions, intervals of the exposed parts of the Cu—Sn alloy layer are between 0.01 and 0.5 mm at least with respect to one direction, and the respective mean thicknesses of the Ni layer and the Cu layer are 3.0 μm or below and 3.0 μm or below, respectively. Desirably, the mean thickness of the Cu layer is 1.0 μm or below. When a plated Cu layer is formed as a base coat, a base Cu layer having a mean thickness between 0.01 and 1 μm underlies the Ni layer.

Surface roughness may be measured on the basis of B0601-1994, JIS. The respective thicknesses of the plated layers and the respective thicknesses of the component layers of the coating after the reflowing process may be measured, for example, by a method that will be described in connection with the following embodiments.

Further concrete matters common to the first and the second embodiment will be described. It is desirable that the surface of the base material has an arithmetic mean roughness Ra of 0.4 μm or above at least with respect to one direction and an arithmetic mean roughness Ra of 4.0 μm or below with respect to all directions. Desirably, the respective mean thicknesses of the plated Ni layer, the plated Cu layer, the plated Sn layer are 3.0 μm or below, between 0.1 and 1.5 μm and between 0.4 to 8.0 μm, respectively. Another plated Sn layer may be formed after the reflowing process.

In the coating thus formed, the Ni layer has a mean thickness of 3.0 μm or below, the Cu—Sn alloy layer has a mean thickness between 0.2 and 3.0 μm, the diameter D1 of the smallest circle touching the surface of the Sn layer including the plated Sn formed after the reflowing process if the Sn plating is executed after the reflowing process, and the Cu—Sn alloy layer in a section of the material perpendicular to the surface of the material is 0.2 μm or below, the diameter D2 of the largest circle touching the surface of the Sn layer and the Cu—Sn alloy layer in a section of the material perpendicular to the surface of the material is between 1.2 and 20 μm and the height y of the highest point in the surface of the material from the highest point in the surface of the Cu—Sn alloy layer is 0.2 μm or below. When the Cu—Sn alloy layer is exposed and the diameter D1 is 0 μm, it is desirable that the diameter D3 of the largest one of circles respectively inscribed in exposed parts of the Cu—Sn alloy layer is 150 μm or below and/or the diameter D4 of the largest one of circles inscribed in exposed parts of the Sn layer is 300 μm or below. Desirably, the mean thickness of the Cu layer is 1.0 μm or below.

Figure 7A:
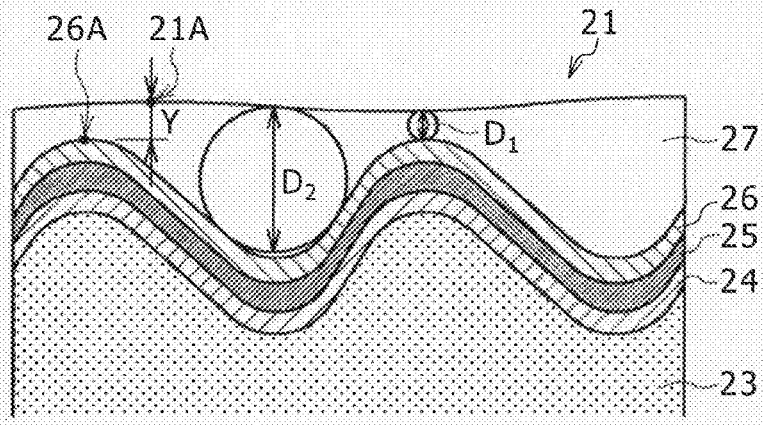
FIGS. 7A and 7B are a typical cross-sectional view taken in a plane perpendicular to the surface of either of the terminal in the first embodiment and a terminal in a second embodiment, and a perspective view of the terminal in either of the first and the second embodiment, respectively.
Figure 7B:
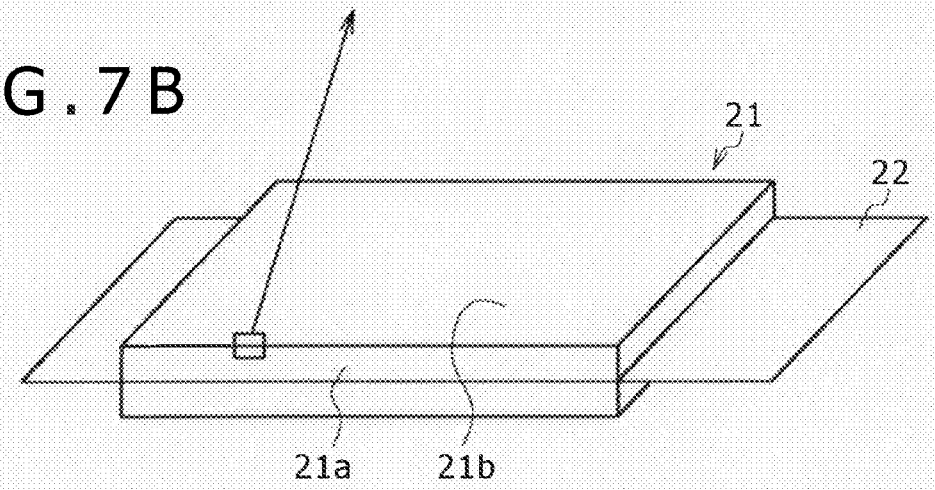

FIG. 7 is a view of assistance in explaining the diameters D1 and D2, and the height y. FIG. 7A is an enlarged, typical sectional view of a part, in the vicinity of a surface 21*b* of a material 21*a*, of a section 21*a* of the material 21 shown in FIG. 7B perpendicular to the surface 21*b* of the material 21 (a section perpendicular to a neutral plane 22 passing the center of a base material if the surface 21*b* is rough). In this example, a Ni layer 24, a Cu layer 25, a Cu—Sn alloy layer 26 and a Sn layer 27 are formed on the surface of the base material 23.

In FIG. 7A, D1 indicates the diameter of the smallest circle touching the surface of the material 21 and the Cu—Sn alloy layer 26, D2 indicates the diameter of the largest circle touching the surface of the material 21 and the Cu—Sn alloy layer 26, and Y indicates the height of a point 21A in the surface of the material 21 farthest from the neutral plane 22, namely, the outermost point of the material 21, from the highest point 26A in the surface of the Cu—Sn alloy layer 26 farthest from the neutral plane 22, namely, the outermost point in the Cu—Sn alloy layer 26, from the neutral plane 22.

Figure 8:
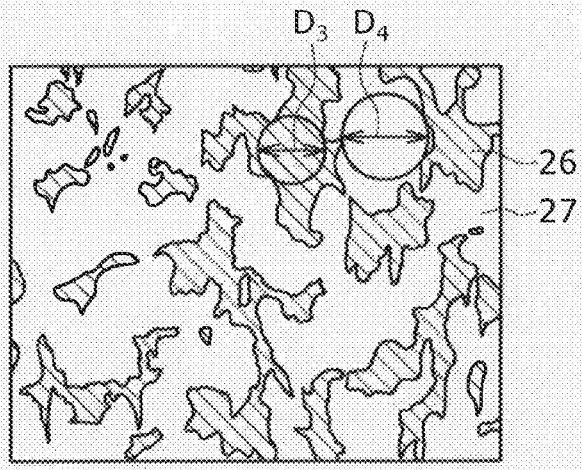
FIG. 8 is a view of the structure of the surface of the terminal in either of the first and the second embodiment.

FIG. 8 is a view of assistance in explaining the diameters D3 and D4, showing the surface of the material 21 in a typical view. The Cu—Sn alloy layer 26 and the Sn layer 27 form the surface. In FIG. 8, D3 indicates the diameter of the largest one of circles respectively inscribed in parts of the Sn layer 27, and D4 indicates the diameter of the largest one of circles inscribed in parts of the Cu—Sn alloy layer 26.

In common with the first and the second embodiment, the surface of the base material is roughened in the foregoing surface roughness by a physical method, such as ion etching, a chemical method, such as etching or electrolytic polishing, or a mechanical method, such as rolling using a work roll having a rough surface finished by grinding or shot blasting, grinding or shot blasting. Rolling and grinding among those methods are desirable because rolling and grinding are excellent in productivity, economic effect and surface morphology reproducibility.

Desirably, the plated Ni, the plated Cu and the plated Sn layer are formed so as to reflect the surface roughness of the base material by electrodeposition, which is capable of achieving uniform deposition, because the sectional structure of the material and the shape of the surface specified by the present invention can be easily controlled.

In common with the first and the second embodiment, it is desirable that the reflowing process heats the material at a temperature not lower than the melting point of the plated Sn layer and not higher than 600° C. for a time between 3 and 30 s so as to melt the plated Sn layer and to make the molten plated Sn layer flow. If the reflowing temperature is above 600° C., it is possible that the amount of elements that diffuse in the molten Sn increases to obstruct the melting and flowing of Sn. If the reflowing time is below 3 s, it is possible that Sn cannot melt and flow satisfactorily. If the reflowing time is above 30 s, it is possible that the amount of elements that diffuse in the molten Sn increases to obstruct the melting and flowing of Sn.

Restrictions on the parameters representing the first and the second embodiment will be described.

(1) The Ni layer suppresses the diffusion of the component elements of the base material into the surface of the material and suppresses the growth of the Cu—Sn alloy layer to prevent the exhaustion of the Sn layer. Thus the Ni layer suppresses the increase of contact resistance when the terminal is used at high temperatures for a long time and when the terminal is used in a corrosive atmosphere of sulfurous acid gas, and provides the terminal with satisfactory solder-wettability. If the mean thickness of the Ni layer is below 0.1 μm, pitting defects in the Ni layer increase and the Ni layer cannot fully exhibit the above-mentioned effects. If the above-mentioned effects are not necessary, the mean thickness may be below 0.1 μm or the Ni layer may be omitted. The above-mentioned effects of the Ni layer saturates when the thickness of the Ni layer is increased to a certain level. An excessively thick Ni layer affects productivity and economical effect adversely. The mean thickness of the Ni layer is 3.0 μm or below or 0 μm, desirably, between 0.1 and 3.0 μm, more desirably, between 0.2 and 2.0 μm.

When the Ni layer is formed, a base Cu layer, namely, a plated Cu base layer, may be formed between the Ni layer and the base material. The plated Cu base layer coats defects, such as pits, in the surface of the base material and deposits on the surface of the base material to improve the adhesion of the plated Ni layer and improves the reliability of the plated Ni layer. The plate Cu base layer has been conventionally used. A desirable thickness of the Cu base layer is between 0.01 and 1 μm.

(2) Although the Cu layer may be omitted, the Cu layer effectively suppresses the diffusion of Ni contained in the Ni layer into the surface of the material and the excessive diffusion of Ni into the Cu—Sn alloy layer when the Ni layer is formed. Particularly, when the Sn layer has thin parts according to the present invention or when the Sn layer does not exist, the Cu layer is effective in suppressing the deposition of nickel oxide having a very high electrical resistance on the surface of the material when the terminal is used at high temperatures for a long time and in suppressing the increase of contact resistance for a long time. The Cu layer has an effect on improving corrosion resistance against sulfurous acid gas. Suppression of the growth of the Cu—Sn alloy layer is difficult and the effect on preventing the exhaustion of the Sn layer reduces if the Cu layer is excessively thick. Voids are formed between the Cu layer and the Cu—Sn alloy layer by thermal diffusion or time-dependent effects. Consequently, hot-peeling resistance reduces, and productivity and economical effect deteriorate. Thus it is desirable that the mean thickness of the Cu layer is 1.0 μm or below, more desirably, 0.5 μm or below.

(3) The Cu—Sn alloy layer is very hard as compared with Sn or a Sn alloy forming the Sn layer. Therefore, when the diameter D1 is 0.2 μm or below and the height y is 0.2 μm or below according to the present invention, deformation resistance due to the digging of the Sn layer that occurs when the terminal is inserted or extracted, and shearing resistance that shears adhesion can be suppressed, and frictional property can be lowered. When an electric contact part slides or slides slightly when the terminal is inserted or extracted or when the terminal is used in a vibrating environment, contact pressure can be born by the hard Cu—Sn alloy layer and area of contact between the Sn layers can be reduced. Consequently, the abrasion and oxidation of the Sn layer due to slight sliding can be reduced. When the Ni layer is formed, the Cu—Sn alloy layer is effective in suppressing the diffusion of Ni contained in the Ni layer into the surface of the material. However, when the mean thickness of the Cu—Sn alloy layer is below 0.2 μm and, particularly, when parts of the Sn layer are thin according to the present invention or the Sn layer is omitted, the amount of nickel oxide and such in the surface of the material increases due to thermal diffusion, such as hot oxidation, contact resistance is liable to increase, corrosion resistance deteriorates and, consequently, it is difficult to maintain reliability on electrical connection. When the mean thickness is above 3.0 μm, productivity and economic effect are unsatisfactory. Therefore, the mean thickness of the Cu—Sn alloy layer shall be between 0.2 and 3.0 μm, more desirably, between 0.3 and 2.0 μm.

(4) When the diameter D1 of the smallest circle touching the Sn layer is above 0.2 μm, deformation resistance due to the digging of the Sn layer that occurs when the terminal is inserted or extracted, and shearing resistance that shears adhesion increase, and it is difficult to lower frictional property. Moreover, slight sliding increases the abrasion and oxidation of the Sn layer to make the suppression of increase in contact resistance difficult. Therefore, the diameter D1 shall be 0.2 μm or below, more desirably, 0.15 μm or below.

(5) When the diameter D2 of the largest circle touching the Sn layer is below 1.2 μm, the exhaustion of the Sn layer due to thermal diffusion and time-dependent effects accelerates the disappearance of the Sn layer. Consequently, effect on improving heat resistance and corrosion resistance reduces, and it is difficult to ensure solder wettability because the amount of the Sn layer is small. When the diameter D2 is above 20 μm, it is possible that adverse effects on mechanical properties arise, and productivity and economic effect become worse. Therefore, the diameter D2 shall be between 1.2 and 20 μm, more desirably, between 1.5 and 10 μm.

(6) When the height y of the highest point in the surface of the material from the highest point in the surface of the Cu—Sn alloy layer is above 0.2 μm, deformation resistance due to the digging of the Sn layer that occurs when the terminal is inserted or extracted and shearing resistance that shears adhesion increase, and it is difficult to lower frictional property. Moreover, slight sliding increases the abrasion and oxidation of the Sn layer to make the suppression of increase in contact resistance difficult. Therefore, the height y shall be 0.2 μm or below, more desirably, 0.15 μm or below.

(7) When the diameter D1 of the smallest circle touching the Sn layer is 0 μm, i.e., when the Cu—Sn alloy layer is exposed partly in the surface of the material, it is desirable that the diameter D3 (FIG. 2) of the largest one of circles respectively inscribed in exposed parts of the Cu—Sn alloy layer is 150 μm or below. When the diameter D3 is above 150 μm, it is possible that only the Cu—Sn alloy layer is in the contact point particularly in a small engaging type terminal. Consequently, effect on suppressing the deterioration of heat resistance and corrosion resistance reduces and it is possible that it is difficult to ensure solder wettability. Desirably, the diameter D3 is 100 μm or below.

(8) It is desirable that the diameter D4 of the largest circle inscribed in the exposed part of the Sn layer is 300 μm or below when the diameter D1 of the smallest circle touching the Sn layer is 0 μm. When the diameter D4 is above 300 μm, the area of Sn layers in contact with each other increases. Consequently, it is possible that deformation resistance due to the digging of the Sn layer and shearing resistance that shears adhesion increase and effect on lowering frictional property reduces. Moreover, slight sliding increases the abrasion and oxidation of the Sn layer to increase contact resistance. More desirably, the diameter D4 is 200 μm or below.

(9) Desirably, the surface of the base material has an arithmetic mean roughness Ra of 0.4 μm or above at least with respect to one direction and an arithmetic mean roughness Ra of 4.0 μm or below with respect to all directions. If the surface roughness Ra in any direction is below 0.4 μm, it is difficult to satisfy the conditions specified by the present invention (particularly, the diameter D2) even if the thicknesses of the plated layers and reflowing conditions are adjusted. If the surface roughness Ra is above 4.0 μm, the melting and flowing properties of Sn are deteriorated.

Desirably, the calculated mean interval Sm of the intervals of the irregularities with respect to one direction is between 0.01 and 0.5 mm. It is difficult, in some cases, to satisfy conditions specified by the present invention (particularly the diameter D2) if the mean interval Sm is below 0.01 mm. It is highly possible that the diameters D3 and D4 are outside the specified ranges, respectively, if the mean interval Sm is above 0.5 mm. More desirably, the maximum height Ry with respect to one direction is between 2.0 and 20 μm. It is difficult, in some cases, to satisfy conditions specified by the present invention (particularly, the diameter D2) if the height Ry is outside that range.

The Sn, the Cu and the Ni layer in each of the first and the second embodiment include layers made of Sn, Cu and Ni, and those made of a Sn alloy, a Cu alloy and a Ni alloy, respectively.

When the Sn layer is made of a Sn alloy, possible component elements other than Sn of the Sn alloy are Pb, Bi, Zn, Ag and Cu. Desirably, the Pb content of the Sn alloy is below 50% by mass, and the Bi, the Zn, the Ag and the Cu content are below 10% by mass.

The Cu layer may contain the component elements of the base material. When the Cu layer is made of a Cu alloy, possible component elements other than Cu are Sn and Zn. Desirably, the Sn content is below 50% by mass, and a desirable content for other elements is below 5% by mass.

The Ni layer may contain the component elements of the base material. When the Ni layer is made of a Ni alloy, possible component elements other than Ni are Cu, P and Co. Desirably, the Cu content is 40% by mass or below, and a desirable content for P and Co is 10% by mass or below.

Similarly, the plated Cu, the plated Sn and the plated Ni layer include plated layers made of Cu, Sn and Ni, and those made of a Cu alloy, a Sn alloy and a Ni alloy, respectively. When the plated Ni, the plated Cu and the plated Sn layer are made of a Ni alloy, a Cu alloy and a Sn alloy, respectively, those alloys may be those respectively forming the Ni, the Cu and the Sn layer, respectively.

EXAMPLES

Examples will be described to prove the capability of the terminal of the present invention for an engaging type connector to exercise the foregoing effects.

Example 1

Example 1 of the present invention will be shown.

Preparation of Test Samples

Processes used for making test samples Nos. 1 to 31 are shown in Tables 1 and 2.

A Cu alloy plate containing Cu, 1.8% by mass Ni, 0.40% by mass Si, 0.10% by mass Sn and 1.1% by mass Zn was processed to provide base materials. The surface of the Cu alloy plate was roughened by using a work roll having a surface roughened by shot blasting for rolling (or not roughened) to provide base materials having a Vickers hardness 200, a thickness of 0.25 mm, and different surface roughnesses, respectively. The respective surface roughnesses of parts of the base materials corresponding to engaging parts of test samples are shown in Tables 3 and 4. The respective surface roughnesses Ra of parts of the base materials corresponding to solder-bonding parts of all the test samples Nos. 1 to 31 are 0.05 μm.

A plated Ni layer (or no plated Ni layer), a plated Cu layer (or no plated Cu layer) and a plated Sn layer were formed on each of the base materials, and the base material was subjected to a reflowing process. Then, the base material was immersed in or not immersed in an ammonium hydrogen fluoride solution, and was subjected again or not subjected to a Sn plating process.

TABLE 1

| Test sample Nos. | | General test sample making processes |
|---|---|---|
| Examples (1) | 1 | Base material → Surface roughening process → Ni plating → Cu plating → Sn plating → Reflowing process |
| | 2 | Base material → Surface roughening process → Ni plating → Cu plating → Sn plating → Reflowing process → Ammonium hydrogen fluoride solution immersion process → Sn plating |
| | 3 | Base material → Surface roughening process → Ni plating → Cu plating → Sn plating → Reflowing process |
| | 4 | Base material → Surface roughening process → Ni plating → Cu plating → Sn plating → Reflowing process → Ammonium hydrogen fluoride solution immersion process → Sn plating |
| | 5 | Base material → Surface roughening process → Ni plating → Cu plating → Sn plating → Reflowing process |
| | 6 | Base material → Surface roughening process → Ni plating → Cu plating → Sn plating → Reflowing process → Ammonium hydrogen fluoride solution immersion process → Sn plating |
| | 7 | Base material → Surface roughening process → Ni plating → Cu plating → Sn plating → Reflowing process |
| | 8 | Base material → Surface roughening process → Ni plating → Cu plating → Sn plating → Reflowing process → Ammonium hydrogen fluoride solution immersion process → Sn plating |
| | 9 | Base material → Surface roughening process → Ni plating → Cu plating → Sn plating → Reflowing process |
| | 10 | Base material → Surface roughening process → Ni plating → Cu plating → Sn plating → Reflowing process |
| | 11 | Base material → Surface roughening process → Ni plating → Cu plating → Sn plating → Reflowing process |
| | 12 | Base material → Surface roughening process → Ni plating → Cu plating → Sn plating → Reflowing process |
| | 13 | Base material → Surface roughening process → Ni plating → Cu plating → Sn plating → Reflowing process |
| | 14 | Base material → Surface roughening process → Ni plating → Cu plating → Sn plating → Reflowing process |
| (2) | 15 | Base material → Surface roughening process → Ni plating → Cu plating → Sn plating → Reflowing process |
| | 16 | Base material → Surface roughening process → Sn plating → Reflowing process → Ammonium hydrogen fluoride solution immersion process → Sn plating |
| | 17 | Base material → Surface roughening process → Cu plating → Sn plating → Reflowing process → Ammonium hydrogen fluoride solution immersion process → Sn plating |
| | 18 | Base material → Surface roughening process → Ni plating → Cu plating → Sn plating → Reflowing process |

TABLE 2

| Test sample Nos. | | General test sample making processes |
|---|---|---|
| Comparative examples | 19 | Base material → Surface roughening process → Ni plating → Cu plating → Sn plating → Reflowing process → Ammonium hydrogen fluoride solution immersion process → Sn plating |
| | 20 | Base material → Surface roughening process → Ni plating → Cu plating → Sn plating → Reflowing process |
| | 21 | Base material → Surface roughening process → Ni plating → Sn plating → Reflowing process → Ammonium hydrogen fluoride solution immersion process → Sn plating |
| | 22 | Base material → Surface roughening process → Ni plating → Cu plating → Sn plating → Reflowing process → Ammonium hydrogen fluoride solution immersion process → Sn plating |
| | 23 | Base material → Surface roughening process → Ni plating → Cu plating → Sn plating → Reflowing process |
| | 24 | Base material → Surface roughening process → Sn plating Reflowing process |
| | 25 | Base material → Surface roughening process → Ni plating → Cu plating → Sn plating → Reflowing process → Ammonium hydrogen fluoride solution immersion process → Sn plating |
| Conventional examples | 26 | Base material → Cu plating → Sn plating → Reflowing process |
| | 27 | Base material → Ni plating → Cu plating → Sn plating → Reflowing process |
| | 28 | Base material → Sn plating → Reflowing process |
| | 29 | Base material → Ni plating → Cu plating → Sn plating → Reflowing process |
| | 30 | Base material → Ni plating → Cu plating → Sn plating → Reflowing process |
| | 31 | Base material → Cu plating → Sn plating → Reflowing process |

The respective mean thicknesses of the Ni layer, the Cu layer and the Cu—Sn alloy layer of each test sample, the shape of a cross section of the material (D1, D2 and Y), the shape of the coating (D3 and D4) were measured by the following methods. Measured data is shown in Tables 3 and 4. Diameters D3 and D4 were measured only in the engaging part.

Method of Measuring Mean thicknesses of Ni Layer, Cu Layer and Cu—Sn Alloy Layer When necessary, a section of the test sample cut by microtomy was subjected to an Ar-ion etching process. The section of the test sample was observed under a SEM (scanning electron microscope) provided with an EDX (energy-dispersive x-ray spectral analyzer). An image having light and dark parts of the section obtained by observation excluding contrasted soils and flaws was analyzed to calculate the respective mean thicknesses of the Ni layer, the Cu layer and the Cu—Sn alloy layer. The observed section was perpendicular to the rolling direction in which the base material was rolled for surface roughening.

Method of Measuring Parameters of Shape of Section Perpendicular to Surface of Material When necessary, a section of the test sample cut by microtomy was subjected to an Ar-ion etching process. The section of the test sample was observed under a SEM (scanning electron microscope) provided with an EDX (energy-dispersive x-ray spectral analyzer). An image having light and dark parts of the section obtained by observation excluding contrasted soils and flaws was analyzed to calculate D1, D2 and Y. The observed section was perpendicular to the rolling direction in which the base material was rolled for surface roughening.

Method of Measuring Shape of Surface of Material

The surface of each test sample was observed under a SEM (scanning electron microscope) provided with an EDX (energy-dispersive x-ray spectral analyzer). An image having light and dark parts of the section obtained by observation excluding contrasted soils and flaws was analyzed to calculate D3 of the largest circle inscribed in a part of the Cu—Sn alloy layer and D4 of the largest circle inscribed in a part of the Sn layer.

TABLE 3

| Test sample Nos. | | Surface roughness of the material Ra (μm) | Component layers: Mean thickness of Ni layer (μm) | Component layers: Mean thickness of Cu layer (μm) | Component layers: Mean thickness of Cu—Sn alloy layer (μm) | Shape of perpendicular section Engaging part: D1 of smallest circle touching Sn layer (μm) | Shape of perpendicular section Engaging part: D2 of largest circle touching Sn layer (μm) | Shape of perpendicular section Engaging part: Height y of highest point in the surface of material from highest point in Cu—Sn alloy layer (μm) |
|---|---|---|---|---|---|---|---|---|
| Examples (1) | 1 | 0.33 | 0.50 | 0.05 | 0.70 | 0 | 2.3 | 0 |
| | 2 | 0.33 | 0.50 | 0.15 | 0.65 | 0.10 | 2.4 | 0.10 |
| | 3 | 0.37 | 0.15 | 0.20 | 0.75 | 0 | 2.6 | 0 |
| | 4 | 0.38 | 2.6 | 0.20 | 0.75 | 0.10 | 2.7 | 0.10 |
| | 5 | 0.28 | 0.30 | 0.85 | 0.50 | 0 | 2.0 | 0 |
| | 6 | 0.48 | 1.0 | 0 | 0.25 | 0.05 | 4.2 | 0.05 |
| | 7 | 0.63 | 2.0 | 0.40 | 2.8 | 0 | 3.2 | 0 |
| | 8 | 0.29 | 1.0 | 0 | 0.50 | 0.15 | 2.1 | 0.15 |
| | 9 | 0.29 | 1.0 | 0.10 | 1.0 | 0 | 1.6 | 0 |
| | 10 | 2.1 | 1.0 | 0.25 | 1.5 | 0 | 18.5 | 0 |
| | 11 | 0.43 | 0.20 | 0 | 2.2 | 0 | 1.8 | 0.15 |
| | 12 | 0.37 | 0.50 | 0.30 | 0.70 | 0 | 2.6 | 0 |
| | 13 | 0.45 | 0.50 | 0 | 0.70 | 0 | 3.5 | 0 |
| | 14 | 0.40 | 0.50 | 0.10 | 0.70 | 0 | 3.0 | 0 |
| (2) | 15 | 0.32 | 0.03 | 0.10 | 0.75 | 0 | 2.1 | 0 |
| | 16 | 0.57 | 0 | 0 | 2.5 | 0.10 | 2.9 | 0.10 |
| | 17 | 0.39 | 0 | 0.05 | 0.85 | 0.15 | 2.7 | 0.15 |
| | 18 | 0.32 | 0.03 | 0.10 | 0.75 | 0.10 | 2.1 | 0.10 |

| Test sample Nos. | | Shape of perpendicular section Solder-bonding part: D1 of smallest circle touching Sn layer (μm) | Shape of perpendicular section Solder-bonding part: D2 of largest circle touching Sn layer (μm) | Shape of perpendicular section Solder-bonding part: Height y of highest point in the surface of material from highest point in Cu—Sn alloy layer (μm) | Surface shape of material: D3 of largest circle inscribed in exposed part of Cu—Sn alloy layer (μm) | Surface shape of material: D4 of largest circle inscribed in exposed part of Sn layer (μm) |
|---|---|---|---|---|---|---|
| Examples (1) | 1 | 1.0 | 1.0 | 0 | 40 | 80 |
| | 2 | 1.1 | 1.1 | 0 | — | — |
| | 3 | 1.0 | 1.0 | 0 | 60 | 80 |
| | 4 | 1.2 | 1.2 | 0 | — | — |
| | 5 | 0.9 | 0.9 | 0 | 30 | 30 |
| | 6 | 1.2 | 1.2 | 0 | — | — |
| | 7 | 1.1 | 1.1 | 0 | 25 | 110 |
| | 8 | 1.0 | 1.0 | 0 | — | — |
| | 9 | 1.2 | 1.2 | 0 | 50 | 100 |
| | 10 | 2.0 | 2.0 | 0 | 5 | 190 |
| | 11 | 2.5 | 2.5 | 0 | 110 | 165 |
| | 12 | 1.0 | 1.0 | 0 | 180 | 70 |
| | 13 | 1.2 | 1.2 | 0 | 35 | 325 |
| | 14 | 1.3 | 1.3 | 0 | 160 | 310 |
| (2) | 15 | 1.0 | 1.0 | 0 | 45 | 85 |
| | 16 | 2.8 | 2.8 | 0 | — | — |
| | 17 | 1.2 | 1.2 | 0 | — | — |
| | 18 | 1.0 | 1.0 | 0 | — | — |

TABLE 4

| Test sample Nos. | | Surface roughness of the material Ra (μm) | Component layers: Men thickness of Ni layer (μm) | Mean thickness of Cu layer (μm) | Mean thickness of Cu—Sn alloy layer (μm) | Shape of perpendicular section Engaging part: D1 of smallest circle touching Sn layer (μm) | D2 of largest circle touching Sn layer (μm) | Height y of highest point in the surface of material from highest point in Cu—Sn alloy layer (μm) |
|---|---|---|---|---|---|---|---|---|
| Comparative example | 19 | 0.34 | 0.50 | 1.2 | 0.60 | 0.10 | 2.5 | 0.10 |
| | 20 | 0.27 | 0.50 | 0.30 | 0.15 | 0 | 2.2 | 0 |
| | 21 | 0.33 | 0.25 | 0 | 0.3 (Ni—Sn) | 0.10 | 2.7 | 0.10 |
| | 22 | 0.41 | 0.50 | 0 | 0.80 | 0.35 | 3.0 | 0.35 |
| | 23 | 0.19 | 0.50 | 0.10 | 0.70 | 0 | 0.7 | 0 |
| | 24 | 0.27 | 0 | 0 | 0.85 | 0.10 | 1.6 | 0.80 |
| | 25 | 0.51 | 0.30 | 0 | 1.40 | 0.15 | 3.4 | 0.40 |
| Conventional examples | 26 | 0.05 | 0 | 0 | 2.5 | 0 | 0 | 0 |
| | 27 | 0.05 | 0.20 | 0 | 1.8 | 0 | 0.20 | 0 |
| | 28 | 0.05 | 0 | 0 | 1.10 | 0 | 4.4 | 4.4 |
| | 29 | 0.05 | 0.50 | 0 | 0.70 | 0.60 | 0.80 | 0.60 |
| | 30 | 0.05 | 0.50 | 0 | 0.70 | 0.15 | 0.40 | 0.15 |
| | 31 | 0.05 | 0 | 0 | 0.75 | 0.55 | 0.85 | 0.55 |

| Test sample Nos. | | Shape of perpendicular section Solder-bonding part: D1 of smallest circle touching Sn layer (μm) | D2 of largest circle touching Sn layer (μm) | Height y of highest point in the surface of material from highest point in Cu—Sn alloy layer (μm) | Surface shape of material: D3 of largest circle inscribed in exposed part of Cu—Sn alloy layer (μm) | D4 of largest circle inscribed in exposed part of Sn layer (μm) |
|---|---|---|---|---|---|---|
| Comparative example | 19 | 1.2 | 1.2 | 0 | — | — |
| | 20 | 1.0 | 1.0 | 0 | 25 | 140 |
| | 21 | 1.1 | 1.1 | 0 | — | — |
| | 22 | 1.0 | 1.0 | 0 | — | — |
| | 23 | 0.9 | 0.9 | 0 | 75 | 80 |
| | 24 | 1.0 | 1.0 | 0 | — | — |
| | 25 | 1.5 | 1.5 | 0 | — | — |
| Conventional examples | 26 | — | — | — | — | — |
| | 27 | — | — | — | 135 | 5 |
| | 28 | — | — | — | 20 | 110 |
| | 29 | — | — | — | — | — |
| | 30 | — | — | — | — | — |
| | 31 | — | — | — | — | — |

The test samples were tested by the following tests including a frictional property evaluation test, a contact resistance evaluation test in a slight-sliding abrasion test, a contact resistance evaluation test after a high-temperature exposure test, a thermal peel resistance test, contact resistance evaluation test and a led-free-solder wettability test after a sulfurous acid gas corrosion test, and a lead-free solder wettability test. Results of those tests are shown in Tables 5 and 6.

Frictional Property Evaluation Test

Figure 9:
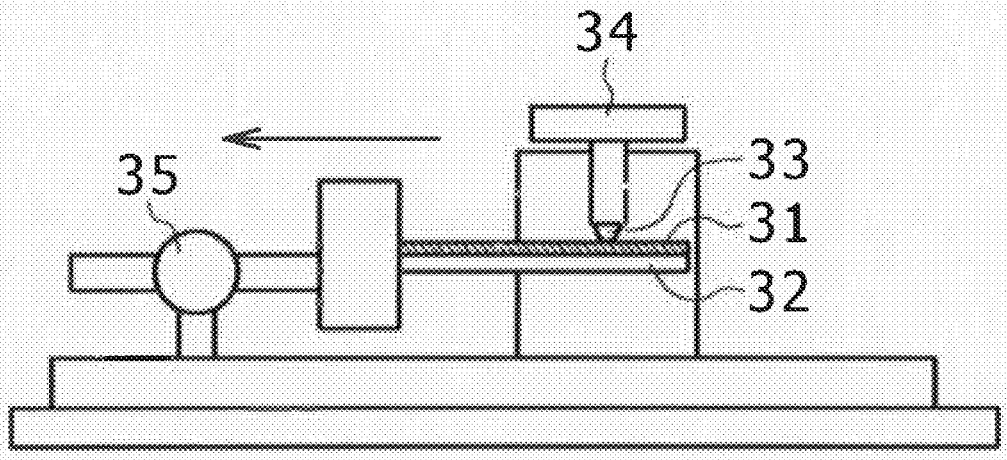
FIG. 9 is a conceptual front elevation of a friction tester used for determining the frictional property of the terminal in either of the first and the second embodiment.

A tester shown in FIG. 9 was used for evaluation. The tester simulates an indented part of an electric contact point of an engaging type connector. A plate-shaped male specimen 31 was cut out from each of the test samples Nos. 1 to 31 and was fixedly placed on a horizontal table 32. A semispherical female specimen 33 having an inside diameter of 1.5 mm was cut out from the test sample No. 31 and was placed on the male specimen 31 with their coatings in contact with each other. A load of 3.0 N was applied to the female specimen 33 by a weight 34 to press the female specimen 33 against the male specimen 31. Then, the male specimen 31 was pulled horizontally at a sliding speed of 80 mm/min by a horizontal load measuring device (Model 2152, AIKOH ENGINEERING Co., LTD.). A frictional force F (N) needed to slide the make specimen 31 5 mm was measured. A friction coefficient was calculated by using the following Expression (1).

$$\text{Friction coefficient}=F/3.0 \quad (1)$$

Contact Resistance Evaluation Test in Slight-Slide Abrasion Test

Figure 10:
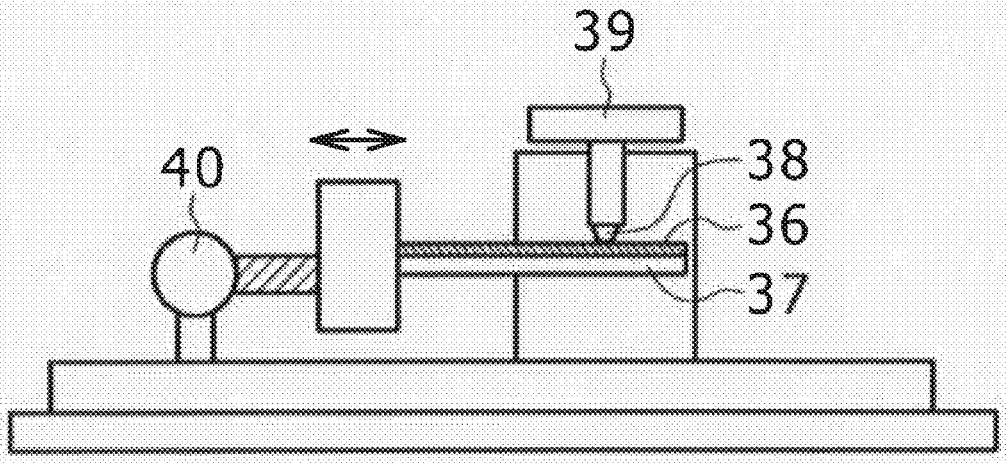
FIG. 10 is a conceptual front elevation of a friction tester used for determining sliding friction acting on the terminal in either of the first and the second embodiment.

A slide tester (CRS-B1050CHO, YAMASAKI-SEIKI CO., LTD.) shown in FIG. 10 was used for evaluation. The tester simulates an indented part of an electric contact point of an engaging type connector. A plate-shaped specimen 36 cut out from the test sample No. 31 was fixedly placed on a horizontal table 37. A semispherical female specimen 38 cut out from each of the test samples Nos. 1 to 31 having an inside diameter of 1.5 mm was placed on the male specimen 36 with their coatings in contact with each other. A load of 2.0 N was applied to the female specimen 38 by a weight 39 to press the female specimen 38 against the male specimen 36. Then, a constant current was passed through the make specimen 36 and the female specimen 38. Then, the male specimen 36 was moved horizontally by a stepping motor 40 for a sliding distance of 50 μm at a sliding frequency of 10 Hz. A maximum contact resistance during 1000 sliding cycles was measured by a four-terminal method using an open-circuit voltage of 20 mV and a current of 10 mA. In FIG. 10 the arrows indicate sliding directions.

Contact Resistance Evaluation Test after High-Temperature Exposure Test

A plate-shaped specimen cut out from each of the test samples Nos. 1 to 31 was heat-treated at 175° C. for 1000 hr. Then, the contact resistance of the specimen was measured by a four-terminal method that moves Au probes horizontally under a load of 3.0 N for a sliding distance of 0.30 mm at a sliding speed of 1.0 mm/min. An open-circuit voltage of 20 mV and a current of 10 mA were used for measurement.

Thermal Peel Resistance Test

A plate-shaped specimen cut out from each of the test samples Nos. 1 to 31 was bent at an angle of bend of 90° in a bend radius of 0.7 mm. The specimen was heated in the atmosphere at 175° C. for 1000 hr. Then, the specimen was straightened in its original shape and the appearance of the specimen was examined for the separation of the coating.

Contact Resistance Evaluation Test after Sulfurous Acid Gas Corrosion Test

A plate-=shaped specimen cut out from each of the test samples Nos. 1 to 31 was held in an atmosphere having a sulfurous acid gas concentration of 25 ppm, a temperature of 35° C. and a humidity of 75% RH for 96 hr for a sulfurous acid gas corrosion test. Then, the contact resistance of the specimen was measured by a four-terminal method that moves Au probes horizontally under a load of 3.0 N for a sliding distance of 0.30 mm at a sliding speed of 1.0 mm/min. An open-circuit voltage of 20 mV and a current of 10 mA were used for measurement.

Lead-Free Solder Wettability Test

A plate-shaped specimen cut out from each of the test samples Nos. 1 to 31 was coated with a non-active flux by dipping the specimen in a non-active flux for 1 s. Wetting time and wetting force were measured by a meniscograph method that dipped the specimen in a Sn-3.0 Ag-0.5 Cu solder at a temperature of 255° C. and a dipping speed of 25 mm/s in a dipping depth of 12 mm for a dipping time of 5.0 s. The appearance of the specimen dipped in the solder was observed to evaluate the wettability of the specimen. Respective Wetting times of both the engaging part and the solder-bonding part of the specimen were measured. The appearance and wettability of only the solder-bonding part were evaluated.

TABLE 5

| | | | Slight slide abrasion | Heat resistance | | Corrosion resistance | Lead-free solder wettability | | | |
|---|---|---|---|---|---|---|---|---|---|---|
| | | | | | | | Engaging part | | | |
| Test sample Nos. | | Insertion effort Friction constant | Contact resistance in slight slide abrasion test (mΩ) | Contact resistance after high-temperature exposure test (mΩ) | Appearance after thermal peel resistance test | Contact resistance after sulfurous acid gas corrosion test (mΩ) | Zero cross time (sec) | Wetting force (mN) | Appearance after solder wettability test | Solder-bonding part Zero cross time (sec) |
| Examples (1) | 1 | 0.22 | 6 | 4 | ○ | 3 | 1.6 | 9.2 | ○ | 0.9 |
| | 2 | 0.28 | 14 | 1 | ○ | 1 | 1.0 | 9.8 | ○ | 0.8 |
| | 3 | 0.23 | 4 | 15 | ○ | 2 | 1.9 | 8.0 | ○ | 0.9 |
| | 4 | 0.28 | 17 | 1 | ○ | 1 | 1.0 | 10.3 | ○ | 0.9 |
| | 5 | 0.22 | 3 | 3 | ○ | 2 | 1.5 | 8.2 | ○ | 0.7 |
| | 6 | 0.29 | 19 | 17 | ○ | 11 | 0.8 | 10.8 | ○ | 0.7 |
| | 7 | 0.25 | 10 | 2 | ○ | 1 | 1.0 | 10.3 | ○ | 0.8 |
| | 8 | 0.32 | 23 | 3 | ○ | 3 | 0.9 | 10.0 | ○ | 0.8 |
| | 9 | 0.24 | 8 | 21 | ○ | 8 | 1.8 | 8.1 | ○ | 0.9 |
| | 10 | 0.29 | 21 | 1 | ○ | 1 | 0.8 | 12.5 | ○ | 0.7 |
| | 11 | 0.31 | 23 | 16 | ○ | 10 | 1.7 | 8.1 | ○ | 1.0 |
| | 12 | 0.20 | 2 | 24 | ○ | 18 | 1.9 | 7.4 | ○ | 0.8 |
| | 13 | 0.32 | 29 | 3 | ○ | 2 | 0.9 | 10.9 | ○ | 0.8 |
| | 14 | 0.31 | 27 | 22 | ○ | 16 | 1.8 | 7.8 | ○ | 0.9 |
| (2) | 15 | 0.23 | 7 | 88 | ○ | 46 | 3.1 | 7.8 | X | 1.2 |
| | 16 | 0.30 | 32 | 50 | X | 45 | 2.4 | 7.2 | ○ | 1.3 |
| | 17 | 0.28 | 35 | 62 | X | 33 | 1.9 | 7.5 | ○ | 1.1 |
| | 18 | 0.23 | 7 | 43 | ○ | 35 | 2.1 | 7.8 | ○ | 1.2 |

TABLE 6

| Test sample Nos. | | Insertion effort Friction constant | Slight slide abrasion Contact resistance in slight slide abrasion test (mΩ) | Heat resistance Contact resistance after high-temperature exposure test (mΩ) | Heat resistance Appearance after thermal peel resistance test | Corrosion resistance Contact resistance after sulfurous acid gas corrosion test (mΩ) | Lead-free solder wettability Engaging part Zero cross time (sec) | Lead-free solder wettability Engaging part Wetting force (mN) | Lead-free solder wettability Engaging part Appearance after solder wettability test | Lead-free solder wettability Solder-bonding part Zero cross time (sec) |
|---|---|---|---|---|---|---|---|---|---|---|
| Comparative examples | 19 | 0.28 | 22 | 64 | X | 4 | 1.1 | 9.8 | ○ | 0.9 |
| | 20 | 0.27 | 17 | 112 | ○ | 70 | 1.4 | 8.6 | ○ | 1.1 |
| | 21 | 0.29 | 26 | >2000 | ○ | 350 | 1.0 | 9.7 | ○ | 1.0 |
| | 22 | 0.47 | 180 | 2 | ○ | 1 | 0.9 | 10.8 | ○ | 0.8 |
| | 23 | 0.23 | 4 | 52 | ○ | 45 | 2.1 | 4.8 | X | 0.7 |
| | 24 | 0.53 | 380 | 180 | X | 71 | 1.2 | 8.1 | ○ | 1.0 |
| | 25 | 0.51 | 260 | 3 | ○ | 2 | 1.3 | 9.6 | ○ | 0.7 |
| Conventional examples | 26 | 0.20 | 2 | 550 | X | 210 | >5.0 | <0.0 | X | 5.0 |
| | 27 | 0.21 | 5 | 45 | ○ | 38 | >5.0 | <0.0 | X | 5.0 |
| | 28 | 0.65 | 1500 | 120 | X | 65 | 3.3 | 8.2 | X | 3.3 |
| | 29 | 0.52 | 210 | 2 | ○ | 1 | 1.2 | 4.6 | ○ | 1.2 |
| | 30 | 0.31 | 35 | 41 | ○ | 35 | 2.4 | 3.3 | X | 2.4 |
| | 31 | 0.50 | 180 | 110 | X | 65 | 1.4 | 4.7 | ○ | 1.4 |

As shown in Tables 3 and 5, the test samples Nos. 1 to 14 meet the conditions specified by the present invention, have low frictional property and are excellent in contact resistance in the slight slide abrasion test, contact resistance after the high-temperature exposure test, appearance after the thermal peel resistance test, contact resistance after the sulfurous acid gas corrosion test and lead-free solder wettability. The solder-bonding part is superior to the engaging part in lead-free solder wettability.

The respective mean thicknesses of the Ni layers of the test samples Nos. 15 to 18 are below 0.1 μm. These test samples have a low frictional property and a comparatively low contact resistance in the slight slide abrasion test.

In the test samples Nos. 19 to 25, the mean thickness of either the Cu layer or the Cu—Sn alloy layer does not meet the desirable condition specified by the present invention, the mean thickness of the Ni layer is outside the desirable range or one of D1, D2 and Y does not meet the desirable condition specified by the present invention, and one or some of the characteristics are not satisfactory.

The test sample No. 21 was made without executing Cu plating after Ni plating. Therefore, this test sample has a Ni—Sn alloy layer instead of a Cu—Sn alloy layer, and hence the contact resistance after the high-temperature exposure test and the contact resistance after the sulfurous acid gas corrosion test of this test sample are high.

The base materials of the test samples Nos. 26 to 31 were not processed by the surface roughening process and hence one or some characteristics thereof are unsatisfactory.

The test sample No. 26 was not processed by Ni plating and the Sn layer thereof was removed completely by a long reflowing process. Most part of the Sn layer of the test sample No. 27 was removed by a long reflowing process. The test sample No. 28 was not processed by Ni plating and Cu plating. The test sample No. 31 was not processed by Ni plating.

Example 2

Example 2 of the present invention will be shown.

Preparation of Test Samples

Processes used for making test samples are the same as those used for making the test samples of the Example 1. The processes used for making test samples Nos. 1 to 31 are shown in Tables 1 and 2.

A Cu alloy plate containing Cu, 1.8% by mass Ni, 0.40% by mass Si, 0.10% by mass Sn and 1.1% by mass Zn was processed to provide base materials. The surface of the Cu alloy plate was roughened by using a work roll having a surface roughened by shot blasting for rolling (or not roughened) to provide base materials having a Vickers hardness 200, a thickness of 0.25 mm, and different surface roughnesses shown in Tables 7 and 8, respectively. The surface roughness of a part of each base material corresponding to a solder-bonding part and that of a part corresponding to an engaging part are the same.

A plated Ni layer (or no plated Ni layer), a plated Cu layer (or no plated Cu layer) and a plated Sn layer were formed in that order on each of the base materials, and the base material was subjected to a reflowing process. Then, the base material was immersed in or not immersed in an ammonium hydrogen fluoride solution, and was subjected again or not subjected to a Sn plating process.

In test samples Nos. 1 to 25, the mean thickness of a part of the Sn layer corresponding to an engaging part is different from that of a part of the Sn layer corresponding to a solder-bonding part.

The respective mean thicknesses of the Ni layer, the Cu layer and the Cu—Sn alloy layer of the specimens, D1, D2 and Y representing the shape of the coating in the perpendicular section of the material, and D3 and D4 representing the shape of the coating in the surface of the material were measured by the same methods as Example 1. Measured data is shown in Tables 7 and 8. Methods of measuring the respective mean thicknesses of the Ni layer, the Cu layer and the Cu—Sn alloy layer, measuring the shape of the coating in the perpendicular section, and measuring the shape of the coating in the surface of the material are the same as Example 1.

As obvious from tables 7 and 8, the difference in the thickness of the Sn layer between the engaging part and the solder-bonding part is represented by the differences in D1, D2 and Y between the engaging part and the solder-bonding part. Since there is not any difference in those values between the engaging part and the solder-bonding part of the specimens Nos. 26 to 31, namely, specimens of comparative examples, those values of only the engaging part were measured.

TABLE 7

| Test sample Nos. | | Surface roughness Ra of the material (μm) | Component layers: Mean thickness of Ni layer (μm) | Mean thickness of Cu layer (μm) | Mean thickness of Cu—Sn alloy layer (μm) | Shape of perpendicular section Engaging part: D1 of smallest circle touching Sn layer (μm) | D2 of largest circle touching Sn layer (μm) | Height y of highest point in the surface of material from highest point in Cu—Sn alloy layer (μm) |
|---|---|---|---|---|---|---|---|---|
| Examples (1) | 1 | 0.33 | 0.50 | 0.05 | 0.70 | 0 | 2.3 | 0 |
| | 2 | 0.33 | 0.50 | 0.15 | 0.65 | 0.10 | 2.4 | 0.10 |
| | 3 | 0.37 | 0.15 | 0.20 | 0.75 | 0 | 2.6 | 0 |
| | 4 | 0.38 | 2.6 | 0.20 | 0.75 | 0.10 | 2.7 | 0.10 |
| | 5 | 0.28 | 0.30 | 0.85 | 0.50 | 0 | 2.0 | 0 |
| | 6 | 0.48 | 1.0 | 0 | 0.25 | 0.05 | 4.2 | 0.05 |
| | 7 | 0.63 | 2.0 | 0.40 | 2.8 | 0 | 3.2 | 0 |
| | 8 | 0.29 | 1.0 | 0 | 0.50 | 0.15 | 2.1 | 0.15 |
| | 9 | 0.29 | 1.0 | 0.10 | 1.0 | 0 | 1.6 | 0 |
| | 10 | 2.1 | 1.0 | 0.25 | 1.5 | 0 | 18.5 | 0 |
| | 11 | 0.43 | 0.20 | 0 | 2.2 | 0 | 1.8 | 0.15 |
| | 12 | 0.37 | 0.50 | 0.30 | 0.70 | 0 | 2.6 | 0 |
| | 13 | 0.45 | 0.50 | 0 | 0.70 | 0 | 3.5 | 0 |
| | 14 | 0.40 | 0.50 | 0.10 | 0.70 | 0 | 3.0 | 0 |
| (2) | 15 | 0.32 | 0.03 | 0.10 | 0.75 | 0 | 2.1 | 0 |
| | 16 | 0.57 | 0 | 0 | 2.5 | 0.10 | 2.9 | 0.10 |
| | 17 | 0.39 | 0 | 0.05 | 0.85 | 0.15 | 2.7 | 0.15 |
| | 18 | 0.32 | 0.03 | 0.10 | 0.75 | 0.10 | 2.1 | 0.10 |

| Test sample Nos. | | Shape of perpendicular section Solder-bonding part: D1 of smallest circle touching Sn layer (μm) | D2 of largest circle touching Sn layer (μm) | Height y of highest point in the surface of material from highest point in Cu—Sn alloy layer (μm) | Surface shape of material: D3 of largest circle inscribed in exposed part of Cu—Sn alloy layer (μm) | D4 of largest circle inscribed in exposed part of Sn layer (μm) |
|---|---|---|---|---|---|---|
| Examples (1) | 1 | 0.6 | 2.9 | 0.6 | 40 | 80 |
| | 2 | 0.7 | 3.0 | 0.7 | — | — |
| | 3 | 0.6 | 3.2 | 0.6 | 60 | 80 |
| | 4 | 0.7 | 3.3 | 0.7 | — | — |
| | 5 | 0.6 | 2.6 | 0.6 | 30 | 30 |
| | 6 | 0.6 | 4.8 | 0.6 | — | — |
| | 7 | 0.6 | 3.8 | 0.6 | 25 | 110 |
| | 8 | 0.7 | 2.7 | 0.7 | — | — |
| | 9 | 0.6 | 2.2 | 0.6 | 50 | 100 |
| | 10 | 0.6 | 24.5 | 0.6 | 5 | 190 |
| | 11 | 0.6 | 2.4 | 0.1 | 110 | 165 |
| | 12 | 0.6 | 3.2 | 0.6 | 180 | 70 |
| | 13 | 0.6 | 4.2 | 0.6 | 35 | 325 |
| | 14 | 0.6 | 3.6 | 0.6 | 160 | 310 |
| (2) | 15 | 0.6 | 2.7 | 0.6 | 45 | 85 |
| | 16 | 0.7 | 3.5 | 0.7 | — | — |
| | 17 | 0.7 | 3.3 | 0.7 | — | — |
| | 18 | 0.7 | 2.7 | 0.7 | — | — |

TABLE 8

| Test sample Nos. | | Surface roughness Ra of the material (μm) | Component layers: Mean thickness of Ni layer (μm) | Component layers: Mean thickness of Cu layer (μm) | Component layers: Mean thickness of Cu—Sn alloy layer (μm) | Shape of perpendicular section Engaging part: D1 of smallest circle touching Sn layer (μm) | Shape of perpendicular section Engaging part: D2 of largest circle touching Sn layer (μm) | Shape of perpendicular section Engaging part: Height y of highest point in the surface of material from highest point in Cu—Sn alloy layer (μm) |
|---|---|---|---|---|---|---|---|---|
| Comparative examples | 19 | 0.34 | 0.50 | 1.2 | 0.60 | 0.10 | 2.5 | 0.10 |
| | 20 | 0.27 | 0.50 | 0.30 | 0.15 | 0 | 2.2 | 0 |
| | 21 | 0.33 | 0.25 | 0 | 0.3 (Ni—Sn) | 0.10 | 2.7 | 0.10 |
| | 22 | 0.41 | 0.50 | 0 | 0.80 | 0.35 | 3.0 | 0.35 |
| | 23 | 0.19 | 0.50 | 0.10 | 0.70 | 0 | 0.7 | 0 |
| | 24 | 0.27 | 0 | 0 | 0.85 | 0.10 | 1.6 | 0.80 |
| | 25 | 0.51 | 0.30 | 0 | 1.40 | 0.15 | 3.4 | 0.40 |
| Conventional examples | 26 | 0.05 | 0 | 0 | 2.5 | 0 | 0 | 0 |
| | 27 | 0.05 | 0.20 | 0 | 1.8 | 0 | 0.20 | 0 |
| | 28 | 0.05 | 0 | 0 | 1.10 | 0 | 4.4 | 4.4 |
| | 29 | 0.05 | 0.50 | 0 | 0.70 | 0.60 | 0.80 | 0.60 |
| | 30 | 0.05 | 0.50 | 0 | 0.70 | 0.15 | 0.40 | 0.15 |
| | 31 | 0.05 | 0 | 0 | 0.75 | 0.55 | 0.85 | 0.55 |

| Test sample Nos. | | Shape of perpendicular section Solder-bonding part: D1 of smallest circle touching Sn layer (μm) | Shape of perpendicular section Solder-bonding part: D2 of largest circle touching Sn layer (μm) | Shape of perpendicular section Solder-bonding part: Height y of highest point in the surface of material from highest point in Cu—Sn alloy layer (μm) | Surface shape of material: D3 of largest circle inscribed in exposed part of Cu—Sn alloy layer (μm) | Surface shape of material: D4 of largest circle inscribed in exposed part of Sn layer (μm) |
|---|---|---|---|---|---|---|
| Comparative examples | 19 | 0.7 | 3.1 | 0.7 | — | — |
| | 20 | 0.6 | 2.8 | 0.6 | 25 | 140 |
| | 21 | 0.7 | 3.3 | 0.7 | — | — |
| | 22 | 0.7 | 3.4 | 0.7 | — | — |
| | 23 | 0.6 | 1.3 | 0.6 | 75 | 80 |
| | 24 | 0.7 | 2.3 | 0.2 | — | — |
| | 25 | 0.7 | 4.0 | 0.1 | — | — |
| Conventional examples | 26 | — | — | — | — | — |
| | 27 | — | — | — | 135 | 5 |
| | 28 | — | — | — | 20 | 110 |
| | 29 | — | — | — | — | — |
| | 30 | — | — | — | — | — |
| | 31 | — | — | — | — | — |

The specimens were tested by a frictional property evaluating test, a contact resistance evaluation test in a slight slide abrasion test, contact resistance evaluation test after a high-temperature exposure test, a thermal peed resistance test, a contact resistance evaluation test and a lead-free solder wettability test after a sulfurous acid gas corrosion test, and a lead-free solder wettability test, which were the same as those by which the specimens of Example 1 were tested. Measured data is shown in Tables 9 and 10

TABLE 9

| Test sample Nos. | | Insertion effort Friction constant | Slight slide abrasion: Contact resistance in slight slide abrasion test (mΩ) | Heat resistance: Contact resistance after high-temperature exposure test (mΩ) | Heat resistance: Appearance after thermal peel resistance test | Corrosion resistance: Contact resistance after sulfurous acid gas corrosion test (mΩ) | Lead-free solder wettability: Engaging part: Zero cross time (sec) | Lead-free solder wettability: Engaging part: Wetting force (mN) | Lead-free solder wettability: Engaging part: Appearance after solder wettability test | Lead-free solder wettability: Solder-bonding part Zero cross time (sec) |
|---|---|---|---|---|---|---|---|---|---|---|
| Examples (1) | 1 | 0.22 | 6 | 4 | ○ | 3 | 1.6 | 9.2 | ○ | 0.8 |
| | 2 | 0.28 | 14 | 1 | ○ | 1 | 1.0 | 9.8 | ○ | 0.9 |

TABLE 9-continued

| Test sample Nos. | | Insertion effort Friction constant | Slight slide abrasion Contact resistance in slight slide abrasion test (mΩ) | Heat resistance Contact resistance after high-temperature exposure test (mΩ) | Heat resistance Appearance after thermal peel resistance test | Corrosion resistance Contact resistance after sulfurous acid gas corrosion test (mΩ) | Lead-free solder wettability Engaging part Zero cross time (sec) | Lead-free solder wettability Engaging part Wetting force (mN) | Lead-free solder wettability Engaging part Appearance after solder wettability test | Lead-free solder wettability Solder-bonding part Zero cross time (sec) |
|---|---|---|---|---|---|---|---|---|---|---|
| | 3 | 0.23 | 4 | 15 | ○ | 2 | 1.9 | 8.0 | ○ | 1.0 |
| | 4 | 0.28 | 17 | 1 | ○ | 1 | 1.0 | 10.3 | ○ | 0.8 |
| | 5 | 0.22 | 3 | 3 | ○ | 2 | 1.5 | 8.2 | ○ | 0.8 |
| | 6 | 0.29 | 19 | 17 | ○ | 11 | 0.8 | 10.8 | ○ | 0.8 |
| | 7 | 0.25 | 10 | 2 | ○ | 1 | 1.0 | 10.3 | ○ | 0.9 |
| | 8 | 0.32 | 23 | 3 | ○ | 3 | 0.9 | 10.0 | ○ | 0.7 |
| | 9 | 0.24 | 8 | 21 | ○ | 8 | 1.8 | 8.1 | ○ | 0.8 |
| | 10 | 0.29 | 21 | 1 | ○ | 1 | 0.8 | 12.5 | ○ | 0.6 |
| | 11 | 0.31 | 23 | 16 | ○ | 10 | 1.7 | 8.1 | ○ | 1.0 |
| | 12 | 0.20 | 2 | 24 | ○ | 18 | 1.9 | 7.4 | ○ | 0.7 |
| | 13 | 0.32 | 29 | 3 | ○ | 2 | 0.9 | 10.9 | ○ | 0.8 |
| | 14 | 0.31 | 27 | 22 | ○ | 16 | 1.8 | 7.8 | ○ | 0.7 |
| (2) | 15 | 0.23 | 7 | 88 | ○ | 46 | 3.1 | 7.8 | X | 1.0 |
| | 16 | 0.30 | 32 | 50 | X | 45 | 2.4 | 7.2 | ○ | 1.1 |
| | 17 | 0.28 | 35 | 62 | X | 33 | 1.9 | 7.5 | ○ | 1.0 |
| | 18 | 0.23 | 7 | 43 | ○ | 35 | 2.1 | 7.8 | ○ | 0.9 |

TABLE 10

| Test sample Nos. | | Insertion effort Friction constant | Slight slide abrasion Contact resistance in slight slide abrasion test (mΩ) | Heat resistance Contact resistance after high-temperature exposure test (mΩ) | Heat resistance Appearance after thermal peel resistance test | Corrosion resistance Contact resistance after sulfurous acid gas corrosion test (mΩ) | Lead-free solder wettability Engaging part Zero cross time (sec) | Lead-free solder wettability Engaging part Wetting force (mN) | Lead-free solder wettability Engaging part Appearance after solder wettability test | Lead-free solder wettability Solder-bonding part Zero cross time (sec) |
|---|---|---|---|---|---|---|---|---|---|---|
| Comparative examples | 19 | 0.28 | 22 | 64 | X | 4 | 1.1 | 9.8 | ○ | 0.7 |
| | 20 | 0.27 | 17 | 112 | ○ | 70 | 1.4 | 8.6 | ○ | 0.8 |
| | 21 | 0.29 | 26 | >2000 | ○ | 350 | 1.0 | 9.7 | ○ | 1.0 |
| | 22 | 0.47 | 180 | 2 | ○ | 1 | 0.9 | 10.8 | ○ | 0.7 |
| | 23 | 0.23 | 4 | 52 | ○ | 45 | 2.1 | 4.8 | X | 0.9 |
| | 24 | 0.53 | 380 | 180 | X | 71 | 1.2 | 8.1 | ○ | 0.9 |
| | 25 | 0.51 | 260 | 3 | ○ | 2 | 1.3 | 9.6 | ○ | 0.8 |
| Conventional examples | 26 | 0.20 | 2 | 550 | X | 210 | >5.0 | <0.0 | X | 5.0 |
| | 27 | 0.21 | 5 | 45 | ○ | 38 | >5.0 | <0.0 | X | 5.0 |
| | 28 | 0.65 | 1500 | 120 | X | 65 | 3.3 | 8.2 | X | 3.3 |
| | 29 | 0.52 | 210 | 2 | ○ | 1 | 1.2 | 4.6 | ○ | 1.2 |
| | 30 | 0.31 | 35 | 41 | ○ | 35 | 2.4 | 3.3 | X | 2.4 |
| | 31 | 0.50 | 180 | 110 | X | 65 | 1.4 | 4.7 | ○ | 1.4 |

As shown in Tables 7 and 9, the test samples Nos. 1 to 14 have coatings whose parameters, namely, thicknesses of the layers of the coating, D1, D2 and Y, are within the desirable ranges specified by the present invention, have low frictional property and are excellent in contact resistance in the slight slide abrasion test, contact resistance after the high-temperature exposure test, appearance after the thermal peel resistance test, contact resistance after the sulfurous acid gas corrosion test and lead-free solder wettability. The solder-bonding part is superior to the engaging part in lead-free solder wettability.

The respective mean thicknesses of the Ni layers of the test samples Nos. 15 to 18 are below 0.1 μm. These test samples have coatings having D1, D2 and Y within the desirable ranges specified by the present invention, have a low frictional property and a comparatively low contact resistance in the slight slide abrasion test.

In the test samples Nos. 19 to 25, the mean thickness of either the Cu layer or the Cu—Sn alloy layer does not meet the desirable condition specified by the present invention, the mean thickness of the Ni layer is outside the desirable range or one of D1, D2 and Y does not meet the desirable condition specified by the present invention, and one or some of the characteristics are not satisfactory.

The test sample No. 21 was made without executing Cu plating after Ni plating. Therefore, this test sample has a Ni—Sn alloy layer instead of a Cu—Sn alloy layer, and hence the contact resistance after the high-temperature exposure test and the contact resistance after the sulfurous acid gas corrosion test of this test sample are high.

The base materials of the test samples Nos. 26 to 31 were not processed by the surface roughening process and hence one or some characteristics thereof are unsatisfactory.

The base materials of the test samples Nos. 26 to 31 were not processed by a surface roughening process and hence one or some of the characteristics of these test samples are unsatisfactory.

The test sample No. 26 was not processed by Ni plating and the Sn layer thereof was removed completely by a long reflowing process. Most part of the Sn layer of the test sample No. 27 was removed by a long reflowing process. The test sample No. 28 was not processed by Ni plating and Cu plating. The test sample No. 31 was not processed by Ni plating.

What is claimed is:

1. A terminal for an engaging type connector comprising:

a punched Cu alloy strip as a base material having a surface;

a coating formed on the surface of the Cu alloy strip by postplating processes and including a Cu—Sn alloy layer and a Sn layer;

wherein the Cu—Sn alloy layer is sandwiched between the surface of the base material and the Sn layer, and the Sn layer is smoothed by a reflowing process, the surface of the base material of the terminal has an engaging part and a solder-bonding part, and a surface portion of said surface of the base material corresponding to the engaging part has a surface roughness higher than that of a surface portion of said surface of the base material corresponding to the solder-bonding part.

2. The terminal for an engaging type connector according to claim 1, wherein the coating includes a Cu layer sandwiched between the Cu—Sn alloy layer and the base material.

3. The terminal for an engaging type connector according to claim 1, wherein the coating includes a Ni layer sandwiched between the Cu—Sn alloy layer and the base material.

4. The terminal for an engaging type connector according to claim 3, wherein the coating further includes a Cu layer sandwiched between the Ni layer and the Cu—Sn alloy layer.

5. The terminal for an engaging type connector according to claim 3, wherein the Ni layer has a mean thickness of 3.0 μm or below, the Cu—Sn alloy layer has a mean thickness between 0.2 and 3.0 μm, a diameter D1 of the smallest circle touching the Sn layer in a section of the engaging part perpendicular to the surface of the engaging part is 0.2 μm or below, the diameter D2 of the largest circle toughing the Sn layer in a section of the engaging part perpendicular to the surface of the engaging part is between 1.2 and 20 μm, a height y of the highest point in the surface of the material from the highest point in the surface of the Cu—Sn alloy layer is 0.2 μm or below, and the solder-bonding part is coated entirely with the Sn layer.

6. The terminal for an engaging type connector according to claim 1, wherein the surface portion of the base material corresponding to the engaging part has an arithmetic mean roughness Ra of 0.15 μm or above at least with respect to one direction and an arithmetic mean roughness Ra of 4.0 μm or below with respect to all directions.

7. The terminal for an engaging type connector according to claim 6, wherein the surface portion of the base material corresponding to the engaging part has an arithmetic mean roughness Ra of 0.3 μm or above at least with respect to one direction.

8. The terminal for an engaging type connector according to claim 6, wherein parts of the Cu—Sn alloy layer corresponding to the engaging part of the terminal are exposed in the surface of the terminal, an areal ratio of the exposed parts of the Cu—Sn alloy layer is between 3% and 75%, and the solder-bonding part is entirely coated with the Sn layer.

9. The terminal for an engaging type connector according to claim 1, wherein the Cu—Sn alloy layer has a mean thickness between 0.1 and 3.0 μm and has a Cu content between 20 and 70 atomic % and the Sn layer has a mean thickness between 0.2 and 5.0 μm.

10. The terminal for an engaging type connector according to claim 1, wherein the Cu—Sn alloy layer has a mean thickness between 0.2 and 3.0 μm, a diameter D1 of the smallest circle touching the Sn layer in a section of the engaging part perpendicular to the surface of the engaging part is 0.2 μm or below, a diameter D2 of the largest circle touching the Sn layer in a section of the engaging part perpendicular to the surface of the engaging part is between 1.2 and 20 μm, a height y of the highest point in the surface of the material from the highest point in the surface of the Cu—Sn alloy layer is 0.2 μm or below, and the solder-bonding part is coated entirely with the Sn layer.

* * * * *